US007645426B2

(12) United States Patent
Merry

(10) Patent No.: US 7,645,426 B2
(45) Date of Patent: Jan. 12, 2010

(54) SANDWICH HYBRID MOUNTING MAT

(75) Inventor: Richard P. Merry, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 680 days.

(21) Appl. No.: 10/824,029

(22) Filed: Apr. 14, 2004

(65) Prior Publication Data

US 2005/0232828 A1 Oct. 20, 2005

(51) Int. Cl.

| | |
|---|---|
| ***B01D 50/00*** | (2006.01) |
| ***F01N 3/10*** | (2006.01) |
| ***C04B 14/00*** | (2006.01) |
| ***B32B 3/14*** | (2006.01) |
| ***B05D 3/02*** | (2006.01) |

(52) U.S. Cl. ..... 422/179; 422/171; 422/174; 422/177; 422/180; 422/221; 123/519; 252/378 R; 427/376.1; 427/402; 427/419.1; 428/57; 428/77

(58) Field of Classification Search ..... 422/179, 422/221, 171, 177, 180, 174, 172; 427/376.1, 427/402, 419.1; 123/519; 252/378 R; 428/57, 428/77

See application file for complete search history.

(56) References Cited

U.S. PATENT DOCUMENTS

| | | | | |
|---|---|---|---|---|
| 3,001,571 | A | 9/1961 | Hatch | |
| 3,458,329 | A | 7/1969 | Owens et al. | |
| 3,760,049 | A | 9/1973 | Borer et al. | |
| 3,916,057 | A | 10/1975 | Hatch et al. | |
| 4,011,651 | A | 3/1977 | Bradbury et al. | |
| 4,048,363 | A * | 9/1977 | Langer et al. | 428/77 |
| 4,156,533 | A | 5/1979 | Close et al. | |
| 4,181,514 | A | 1/1980 | Lefkowitz et al. | |
| 4,220,559 | A | 9/1980 | Polinski | |
| 4,265,953 | A * | 5/1981 | Close | 428/78 |
| 4,305,992 | A | 12/1981 | Langer et al. | |
| 4,385,135 | A | 5/1983 | Langer et al. | |
| 4,521,333 | A | 6/1985 | Graham et al. | |
| 4,863,700 | A | 9/1989 | Ten Eyck | |
| 4,999,168 | A * | 3/1991 | Ten Eyck | 422/179 |
| 5,008,086 | A * | 4/1991 | Merry | 422/180 |
| 5,028,397 | A | 7/1991 | Merry | |
| 5,032,441 | A | 7/1991 | Ten Eyck et al. | |
| 5,078,822 | A | 1/1992 | Hodges et al. | |
| 5,207,989 | A | 5/1993 | MacNeil | |
| 5,242,871 | A | 9/1993 | Hashimoto et al. | |
| 5,250,269 | A | 10/1993 | Langer | |
| 5,254,410 | A | 10/1993 | Langer et al. | |
| 5,258,216 | A * | 11/1993 | von Bonin et al. | 428/102 |
| 5,332,609 | A * | 7/1994 | Corn | 428/77 |
| 5,332,699 | A | 7/1994 | Olds et al. | |

(Continued)

FOREIGN PATENT DOCUMENTS

DE 4305198 C1 * 5/1994

(Continued)

OTHER PUBLICATIONS

Gulati et al., "*New Developments in Packaging of Ceramic Honeycomb Catalysts*", SAE Technical Paper 922252, pp. 91-99 (1992).

(Continued)

*Primary Examiner*—Walter D Griffin
*Assistant Examiner*—Huy-Tram Nguyen
(74) *Attorney, Agent, or Firm*—Harold C. Knecht, III

(57) ABSTRACT

Multilayer mats, pollution control devices containing the multilayer mats, and methods of making the multilayer mats are described. The multilayer mats include an intumescent layer sandwiched between two non-intumescent layers. The non-intumescent layers contain inorganic fibers and have a larger area than the intumescent layer.

25 Claims, 5 Drawing Sheets

U.S. PATENT DOCUMENTS

| | | | | | |
|---|---|---|---|---|---|
| 5,376,341 | A | * | 12/1994 | Gulati | 422/179 |
| 5,385,873 | A | | 1/1995 | MacNeill | |
| 5,449,500 | A | * | 9/1995 | Zettel | 422/179 |
| 5,482,686 | A | | 1/1996 | Lebold et al. | |
| 5,580,532 | A | | 12/1996 | Robinson et al. | |
| 5,585,312 | A | | 12/1996 | Ten Eyck et al. | |
| 5,666,726 | A | | 9/1997 | Robinson et al. | |
| 5,714,421 | A | | 2/1998 | Olds et al. | |
| 5,724,735 | A | | 3/1998 | Ickes et al. | |
| 5,811,063 | A | | 9/1998 | Robinson et al. | |
| 5,853,675 | A | | 12/1998 | Howorth | |
| 5,866,079 | A | * | 2/1999 | Machida et al. | 422/179 |
| 5,874,375 | A | | 2/1999 | Zoitos et al. | |
| 6,051,193 | A | | 4/2000 | Langer et al. | |
| 6,077,483 | A | * | 6/2000 | Locker et al. | 422/179 |
| 6,158,120 | A | * | 12/2000 | Foster et al. | 29/890 |
| 6,159,430 | A | * | 12/2000 | Foster | 422/179 |
| 6,224,835 | B1 | | 5/2001 | Langer | |
| 6,365,267 | B1 | | 4/2002 | Langer et al. | |
| 6,596,120 | B2 | | 7/2003 | Davis et al. | |
| 6,613,295 | B1 | | 9/2003 | Kageyama et al. | |
| 6,967,006 | B1 | * | 11/2005 | Wirth et al. | 422/179 |
| 7,179,429 | B1 | * | 2/2007 | Maus | 422/179 |
| 2001/0046456 | A1 | | 11/2001 | Langer et al. | |
| 2002/0025750 | A1 | * | 2/2002 | Dinwoodie | 442/138 |
| 2002/0025904 | A1 | | 2/2002 | Goto et al. | |
| 2003/0124930 | A1 | | 7/2003 | Horrocks et al. | |
| 2006/0154040 | A1 | | 7/2006 | Merry | |

FOREIGN PATENT DOCUMENTS

| | | | |
|---|---|---|---|
| EP | 0 319 299 | A2 | 6/1989 |
| EP | 0 396 331 | A1 | 11/1990 |
| EP | 0 492 977 | A1 | 7/1992 |
| EP | 0 579 956 | A1 | 1/1994 |
| EP | 0 602 018 | A1 | 6/1994 |
| EP | 0 639 700 | B1 | 2/1995 |
| EP | 0 639 701 | A1 | 2/1995 |
| EP | 0 639 702 | A1 | 2/1995 |
| EP | 1 314 866 | A2 | 5/2003 |
| GB | 1 425 934 | | 2/1976 |
| GB | 1 445 331 | | 8/1976 |
| JP | 56- 85012 | | 7/1981 |
| JP | 58-13683 | | 1/1983 |
| JP | 7-91124 | | 10/1995 |
| JP | 10-288032 | | 10/1998 |
| WO | WO 94/24425 | | 10/1994 |
| WO | WO 98/04404 | | 2/1998 |
| WO | WO 99/39086 | A1 * | 8/1999 |
| WO | WO 99/46028 | | 9/1999 |
| WO | WO 03/031368 | | 4/2003 |
| WO | WO 2004/011785 | | 2/2004 |

OTHER PUBLICATIONS

Richard Merry, EP application No. #03101686.8, filed Jun. 10, 2003.

Bode et al., *Material Aspects in Automotive Pollution Control Devices*, Wiley-VCH, pp. 206-208 (2002).

Howitt et al., "*Cellular Ceramic Diesel Particulate Filter*", SAE Technical Paper 810114 (1981).

* cited by examiner

SANDWICH HYBRID MOUNTING MAT

FIELD OF INVENTION

A multilayer mat is disclosed that is suitable for use in mounting a pollution control element within a pollution control device.

BACKGROUND

Pollution control devices are used on motor vehicles to reduce atmospheric pollution. Two types of devices are currently in widespread use: catalytic converters and diesel particulate filters or traps. Catalytic converters contain one or more catalysts, which are typically coated on the surface of a monolithic structure. The monolithic structure is typically ceramic, although metal monoliths have been used. The catalyst(s) oxidize carbon monoxide and hydrocarbons or reduce the oxides of nitrogen in exhaust gases. Diesel particulate filters or traps typically are in the form of wall flow filters that have a honeycombed monolithic structure made from porous crystalline ceramic materials. In the current state-of-the-art construction of these pollution control devices, the monolithic structure of each type is enclosed within a metal housing.

Protective packing materials are typically positioned between the monolith and the metal housing to protect the monolith from road shock and vibration, to compensate for the thermal expansion difference between the metal housing and the monolith, and to prevent exhaust gases from passing between the monolith and the metal housing. The process of positioning the protective packing material is referred to as "canning" and includes such processes as injecting a paste into a gap between the monolith and the metal housing, or wrapping a sheet material (i.e., mounting mat) around the monolith and inserting the wrapped monolith into the housing, pressing the housing closed, and welding flanges along the lateral edges of the housing.

Typically, the compositions used to form conventional protective packing materials include glass or refractory ceramic fibers that provide properties such as high temperature durability, good handling, resiliency, flexibility, and strength. An intumescent material can also be included that enables the protective packing materials to volumetrically expand at elevated temperatures. Such expansion can help hold the monolith in place during use.

SUMMARY

Multilayer mats, pollution control devices containing the multilayer mats, and methods of making the multilayer mats are provided. More specifically, the multilayer mats include an intumescent layer sandwiched between two non-intumescent layers.

In one aspect, a multilayer mat is provided that includes at least three layers: an intumescent layer having a first major surface and a second major surface opposite the first major surface; a first non-intumescent layer facing the first major surface of the intumescent layer; and a second non-intumescent layer facing the second major surface of the intumescent layer. The intumescent layer has an area A1. The first non-intumescent layer contains inorganic fibers and has an area A2 that is greater than area A1. The second non-intumescent layer contains inorganic fibers and has an area A3 that is greater than A1. The intumescent layer is positioned entirely within the area of both the first non-intumescent layer and the second non-intumescent layer.

In another aspect, a method of forming a multilayer mat is described. An intumescent layer is provided that has a first major surface and a second major surface opposite the first major surface. The intumescent layer has an area A1. A first non-intumescent layer is positioned to face the first major surface of the intumescent layer. The first non-intumescent layer contains inorganic fibers and has an area A2 that is greater than area A1. A second non-intumescent layer is positioned to face the second major surface of the intumescent layer. The second non-intumescent layer contains inorganic fibers and has an area A3 that is greater than area A1. The intumescent layer is positioned entirely within the area of both the first non-intumescent layer and the second non-intumescent layer.

Yet another aspect of the invention provides a pollution control device that includes an outer metal housing, a pollution control element, and a multilayer mat positioned between the pollution control element and the outer metal housing. The multilayer mat has at least three layers: an intumescent layer having a first major surface and a second major surface opposite the first major surface; a first non-intumescent layer facing the first major surface of the intumescent layer; and a second non-intumescent layer facing the second major surface of the intumescent layer. The intumescent layer has an area A1. The first non-intumescent layer contains inorganic fibers and has an area A2 that is greater than area A1. The second non-intumescent layer contains inorganic fibers and has an area A3 that is greater than A1. The intumescent layer is positioned entirely within the area of both the first non-intumescent layer and the second non-intumescent layer.

As used herein, the terms "a", "an", and "the" are used interchangeably with "at least one" to mean one or more of the elements being described.

BRIEF DESCRIPTION OF THE DRAWINGS

The invention can be more completely understood in consideration of the following detailed description of various embodiments of the invention in connection with the accompanying drawings, in which.

Figure 1:
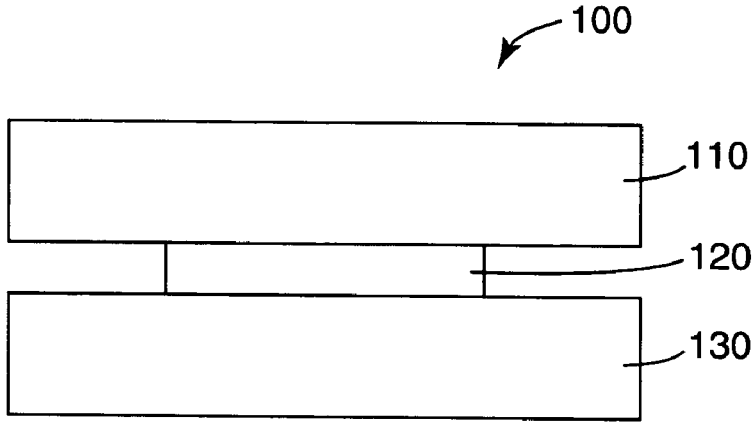
FIG. 1 is a schematic cross-sectional view of one embodiment of a multilayer mat.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

Multilayer mats are provided that include an intumescent layer sandwiched between two non-intumescent layers. The area of each non-intumescent layer is greater than the area of the intumescent layer and the intumescent layer is positioned entirely within the area of both the first non-intumescent layer and the second non-intumescent layer.

More specifically, a multilayer mat is provided that includes at least three layers: an intumescent layer having a first major surface and a second major surface opposite the first major surface; a first non-intumescent layer facing the first major surface of the intumescent layer; and a second non-intumescent layer facing the second major surface of the intumescent layer. The intumescent layer has an area A1. The first non-intumescent layer contains inorganic fibers and has an area A2 that is greater than area A1. The second non-intumescent layer contains inorganic fibers and has an area A3 that is greater than A1.

In some embodiments of the multilayer mat, the area A2 of the first non-intumescent layer is substantially equal to the area A3 of the second non-intumescent layer. As used herein, the term "substantially equal" refers to a first measurement that differs from a second measurement by a value less than about 10 percent. In some embodiments, the first measurement differs from the second measurement by less than 8 percent, less than 7 percent, less than 5 percent, less than 3 percent, less than 2 percent, or less than 1 percent.

In some multilayer mats where area A2 is substantially equal to area A3, the first non-intumescent layer has a length L2 and the second non-intumescent layer has a length substantially equal to length L2 . Additionally, the first non-intumescent layer has a width W2 and the second non-intumescent layer has a width substantially equal to width W2.

In many embodiments of the multilayer mats, the first non-intumescent layer is aligned with the second non-intumescent layer. However, one of the layers can be somewhat skewed compared to the other layer as long as the multilayer mat can be effectively wrapped around a pollution control element within a pollution control device.

As used herein, the term "width" refers to the shorter of two dimensions in the plane of a layer or mat. Conversely, the term "length" refers to the longer of two dimensions in the plane of a layer or mat. The terms width and length are interchangeable if both dimensions are substantially equal. The width and the length refer to the outer dimensions of a layer or mat.

As used herein, the term "area" refers to the area of a layer or mat calculated from the outer dimensions of a layer or mat (i.e., for a rectangular mat, the area is equal to the length multiplied by the width). Thus, a layer or mat that includes a trough can have an area that is substantially equal to that of a layer or mat free of a trough if the outer dimensions are substantially equal.

As used herein, the term "trough" refers to a layer or mat with a non-flat surface in which a portion of the surface is depressed compared to adjoining portions of the surface.

As used herein, the term "surface area" does not refer to the area calculated from the outer dimensions of a layer or mat. Rather, the surface area considers the surface characteristics (e.g., contours) of the layer or mat. A mat or layer with the same outer dimensions can have different surface areas. For example, if one mat or layer has a surface that includes a trough, it will have a higher surface area than a mat or layer having the same outer dimensions that is flat.

A schematic cross-sectional view of one embodiment of the multilayer mat 100 is shown in FIG. 1. The cross-sectional view is parallel to the width of the multilayer mat. The multilayer mat includes three layers arranged in the following order: a first non-intumescent layer 110 that contains inorganic fibers, an intumescent layer 120, and a second non-intumescent layer 130 that contains inorganic fibers. In the embodiment of a multilayer mat exemplified in FIG. 1, the intumescent layer 120 has a smaller width than either the first non-intumescent layer 110 or the second non-intumescent layer 130.

Although FIG. 1 shows a multilayer mat having only three layers, additional intumescent layers, additional non-intumescent layers, or combinations thereof may be present. The multilayer mats can have, for example, two or more adjacent intumescent layer, two or more adjacent non-intumescent layers, or alternating non-intumescent and intumescent layers.

Some specific examples of multilayer mats include, but are not limited to, layers arranged in the following order: non-intumescent/intumescent/non-intumescent/intumescent/non-intumescent; non-intumescent/non-intumescent/intumescent/non-intumescent; non-intumescent/intumescent/intumescent/non-intumescent; and the like. All of these examples include an intumescent layer sandwiched between two non-intumescent layers. All of these examples include non-intumescent outer layers.

As used herein, "intumescent" refers to a material that exhibits at least 10 percent free expansion in thickness when heated to a temperature of about 800° C. to about 900° C. Some intumescent materials have at least 12 percent, at least 15 percent, or at least 20 percent free expansion in thickness when heated to these temperatures. The intumescent material can usually expand, at least to some extent, at a temperature of at least about 400° C. or at least about 500° C. Free expansion refers to the amount of expansion in the Z-axis that the material undergoes when heated without constraints.

As used herein, "non-intumescent" refers to a material that exhibits less than 10 percent free expansion in thickness under the same conditions. Some non-intumescent materials expand less than 8 percent, less than 6 percent, less than 4 percent, less than 2 percent, or less than 1 percent when heated.

Figure 2A:
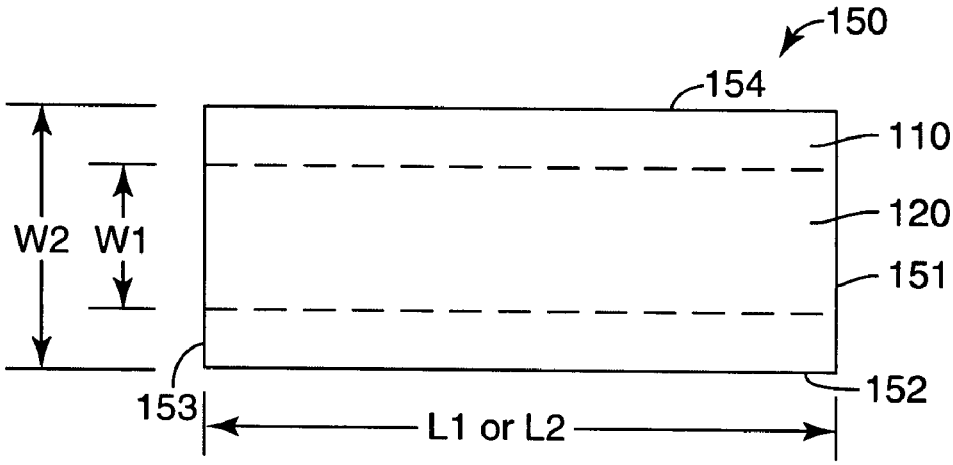
FIGS. 2A and 2B are schematic top views of different embodiments of multilayer mats where the intumescent layer extends over the entire length of the multilayer mat.

FIG. 2A shows a schematic top view of one embodiment of a multilayer mat 150. The first non-intumescent layer 110 is positioned above the intumescent layer 120. Only the first non-intumescent layer 110 is visible when the multilayer mat is viewed from the top. The intumescent layer 120 has a smaller width W1 than the width W2 of the first non-intumescent layer 110. The intumescent layer 120 has a length L1 that is substantially equal to the length L2 of the first non-intumescent layer 110. That is, in this embodiment, the intumescent layer 120 extends along the entire length of the multilayer mat 150.

The second non-intumescent layer (not shown) is aligned with the first non-intumescent layer 110 in FIG. 2A. The area, width, and length of the second non-intumescent layer is substantially equal to the corresponding area A2, width W2 and length L2 of the first non-intumescent layer 110. The area A1 of the intumescent layer 120 is less than the area A2 of the first non-intumescent layer 110 and less than the area of the second non-intumescent layer. That is, the area A2 is greater than the area A1.

In FIG. 2A, the intumescent layer 120 is positioned relative to the non-intumescent layer 110 so that both of the outer edges 152 and 154 of the multilayer mat 150 in the length direction are free of intumescent material. At least with some multilayer mats 150 that are under compression, the thickness of the intumescent layer 120 is selected so that the first non-intumescent layer 110 can contact the second non-intumescent layer along both of the outer edges 152 and 154 of the multilayer mat 150 in the length direction.

Figure 2B:
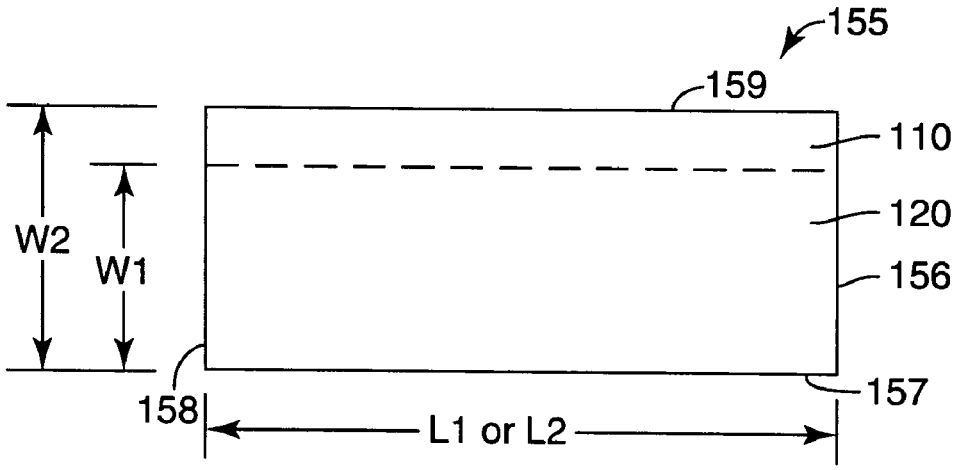

FIG. 2B is similar to FIG. 2A with the exception that the intumescent layer 120 is positioned relative to the non-intumescent layer 110 so that one but not both of the outer edges 157 and 159 of the multilayer mat 155 in the length direction are free of intumescent material (i.e., edge 159 is free of intumescent material while edge 157 is not). At least with some multilayer mats 155 that are under compression, the thickness of the intumescent layer 120 is selected so that the first non-intumescent layer 110 can contact the second non-intumescent layer (not shown but aligned with the first non-intumescent layer) along one edge 159 of the multilayer mat. The width W1 of the intumescent layer is less than the width W2 of the first non-intumescent layer 110 and less than the width of the second non-intumescent layer. Similarly, the area A1 of the intumescent layer is less than the area A2 of the first non-intumescent layer and less than the area of the second non-intumescent layer. That is, the area A2 is greater than the area A1.

Figure 3A:
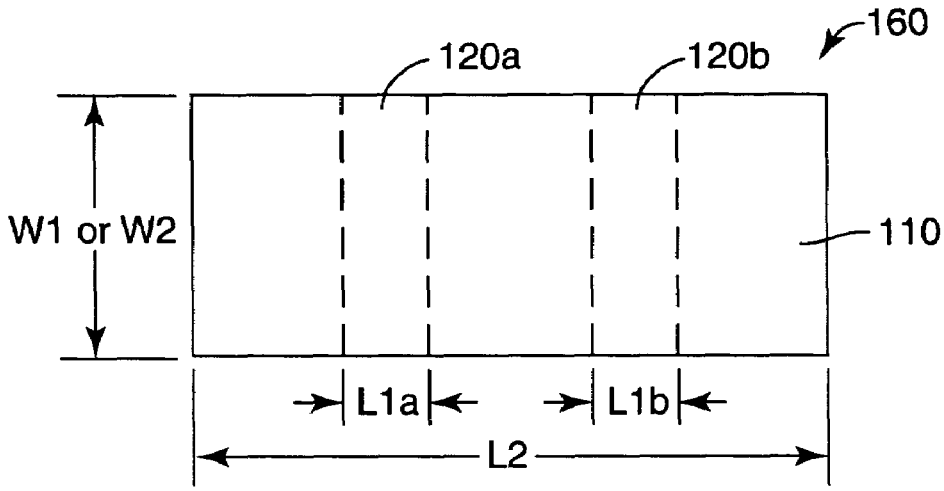
FIGS. 3A and 3B are schematic top views of different embodiments of multilayer mats where the intumescent layer is segmented and extends over less than the entire length of the multilayer mat.

FIG. 3A shows a schematic top view of another embodiment of a multilayer mat 160 where the intumescent layer is divided into two or more segments. In this multilayer mat 160, the intumescent layer is divided into intumescent segments 120*a* and 120*b* that are separated from each other. The intumescent layer extends for less than the entire length of the multilayer mat. That is, the sum of the length L1 a for intumescent segment 120*a* and the length L1 b for intumescent segment 120*b* is less than L2 , the length of the first non-intumescent layer 110. The width W1 of each intumescent segment 120*a* and 120*b* is substantially equal to the width W2 of the first non-intumescent layer. The total area A1 of the intumescent layer (sum of the areas of the different intumescent segments 120*a* and 120*b*) is less than the area A2 of the first non-intumescent layer 110 (i.e., area A2 is greater than area A1). The second non-intumescent layer, which is not shown but is aligned with the first non-intumescent layer, has an area, a length, and a width substantially equal to those of the first non-intumescent layer.

Figure 3B:
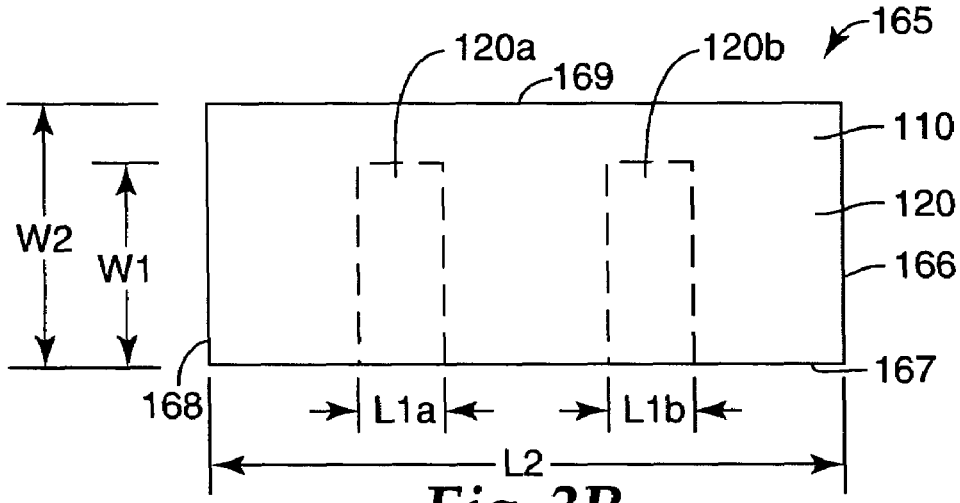

The segments of the intumescent layer can have the same width as the first non-intumescent layer (as shown in FIG. 3A) or can have a smaller width than the first non-intumescent layer (as shown in FIG. 3B). Further, the individual intumescent segments can have substantially equal or different lengths and substantially equal or different widths.

In some multilayer mats as shown in FIG. 3B, the intumescent layer segments 120*a* and 120*b* are positioned relative to the first non-intumescent layer 110 so that at least one of the outer edges 169 of the multilayer mat 165 along the length direction is free of intumescent material. The thickness of the intumescent layer segments 120*a* and 120*b* can be selected such that when the multilayer mat 165 is under compression, the first non-intumescent layer 110 contacts the second non-intumescent along at least one edge 169 of the multilayer mat 165 along the length direction.

Figure 3C:
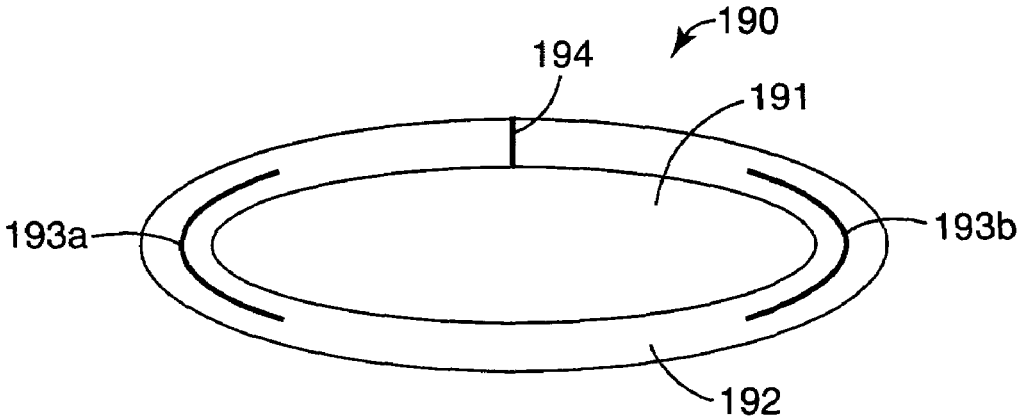
FIG. 3C is a schematic cross-sectional view of one embodiment of a multilayer mounting mat wrapped around an elliptical shaped pollution control element.

The multilayer mats can be wrapped around a pollution control element to provide insulation between the metal housing and the pollution control element. The multilayer mats shown in FIGS. 3A and 3B can be used, for example, as a mounting mat in a pollution control device with a pollution control element having an elliptical cross-section as shown in FIG. 3C. In FIG. 3C, the multilayer mat 192 is wrapped around the pollution control element 191. The intumescent segments 193A and 193B are positioned over regions of the pollution control element having the smallest radius of curvature. In the multilayer mat 192, one of the non-intumescent layers is between the pollution control element 191 and the intumescent segments 193A and 193B.

Figure 4A:
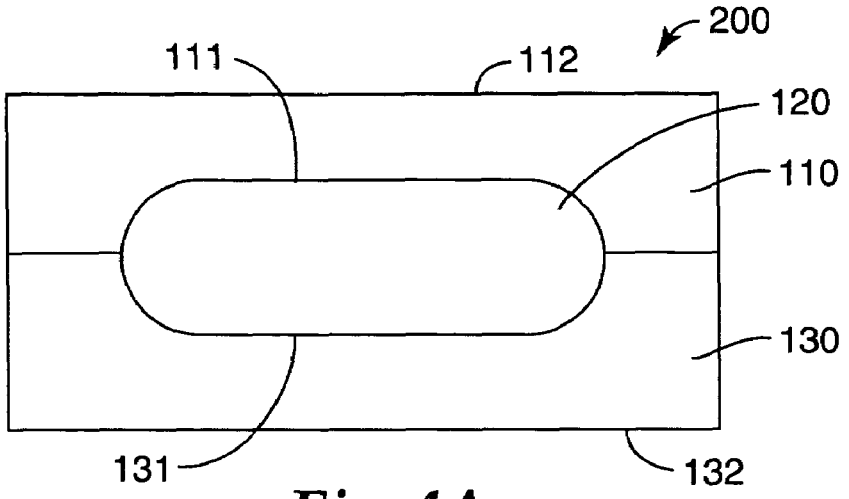
FIGS. 4A and 4B are schematic cross-sectional views of embodiments of multilayer mats having at least one non-intumescent layer with a non-flat major surface facing the intumescent layer.

The surface of the first non-intumescent layer and the surface of the second non-intumescent layer that face the intumescent layer can be flat as shown in FIG. 1. In other embodiments, the surface of the first non-intumescent layer that faces the intumescent layer, the surface of the second non-intumescent that faces the intumescent layer, or the surfaces of both the first and second non-intumescent layers that face the intumescent layer can have a trough. The trough can be as shown in FIG. 4A, a cross-sectional schematic representation of one embodiment of a multilayer mat. The cross-sectional view is along the width of the multilayer mat 200. Each of the non-intumescent layers 110 and 130 has a trough on the major surface facing the intumescent layer (i.e., first trough 111 in the first non-intumescent layer and second trough 131 in the second non-intumescent layer). The first trough 111 is aligned with the second trough 131 to provide a cavity for placement of the intumescent layer 120.

Although the trough in FIG. 4A has a depth that is equal to about 50 percent of the thickness of the non-intumescent layers, any trough depth can be used. In some examples, the trough is no greater than 50 percent, no greater than 40 percent, no greater than 30 percent, no greater than 20 percent, or no greater than 10 percent of the thickness of the non-intumescent layer. Further, although FIG. 4A depicts a U-shaped trough, the trough can have any shape suitable for placement of the intumescent layer therein.

In some multilayer mats, there are multiple troughs in the non-intumescent layer, the intumescent layer is segmented, a segment of the intumescent layer is positioned in each trough.

The major surfaces of the non-intumescent layers opposite the intumescent layer 120 are flat (i.e., surfaces 112 and 132 are flat in FIG. 4A). The intumescent layer 120 fits in the cavity formed by the first trough 111 in the first non-intumescent layer 110 and the second trough 131 in the second non-intumescent layer 130. The width W2 of the first non-intumescent layer 110 is substantially equal to the width of the second non-intumescent layer 130 (i.e., the width is determined from the outer dimensions of the layer). The width W1 of the intumescent layer is usually no larger than the width of the cavity formed by the first trough 111 and the second trough 131.

The surface area of the side of each non-intumescent layer facing the intumescent layer (i.e., the sides containing troughs 111 and 131 in FIG. 4A) is greater than the surface area of the side of each non-intumescent layer opposite the intumescent layer (i.e., sides 112 and 132 in FIG. 4A). However, the surface area of the side of the first non-intumescent layer facing the intumescent layer (i.e., the side containing trough 111 in FIG. 4A) can be substantially equal to or different than the surface area of the side of the second non-intumescent layer facing the intumescent layer (i.e., the side containing trough 131 in FIG. 4A). These two surface areas can be substantially equal, for example, when the dimensions of the troughs are substantially equal. Regardless of the surface areas of the sides of the non-intumescent layers facing the intumescent layer, the area A2 of the first non-intumescent layer in FIG. 4A is substantially equal to the area of the second non-intumescent layer (i.e., the area A2 is calculated from the outer dimensions of the layers; the length of width of these two layers are substantially equal).

Figure 4B:
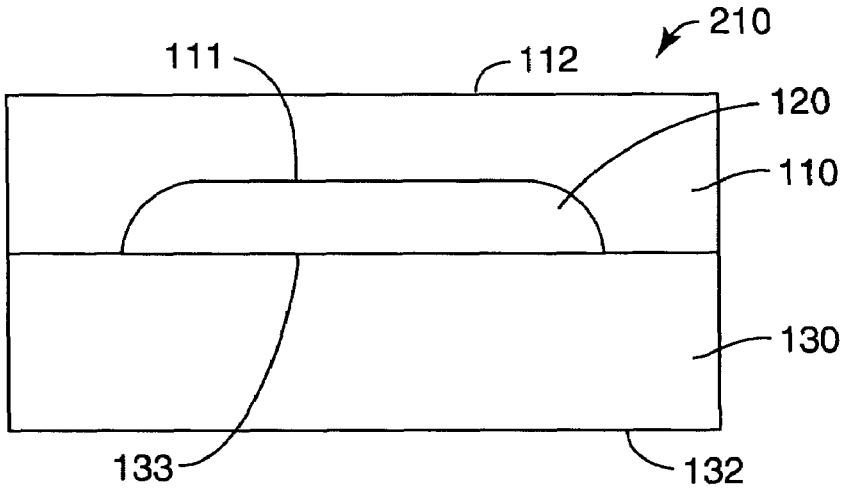

In other embodiments, as shown in FIG. 4B, one of the non-intumescent layers has a trough on the major surface facing the intumescent layer and the other non-intumescent layer has a flat surface facing the intumescent layer. FIG. 4B is a schematic cross-sectional view along the width of the multilayer mat. The intumescent layer 120 fits in the cavity formed by the first trough 111 in the first non-intumescent layer 110 and the flat surface 133 of the second non-intumescent layer 130. The outer surfaces of the non-intumescent layers (i.e., surfaces 112 and surfaces 132) are flat. The surface area of the first non-intumescent layer facing the intumescent layer 120 is not equal to the surface area of the second non-intumescent layer facing the intumescent layer although the overall dimensions (i.e., length and width) of these two layers are substantially equal. Because the overall dimensions of the first and second non-intumescent layers are substantially equal, the areas of these two layers are substantially equal.

The multilayer mats are typically flexible. The mats usually can be handled and wrapped around a pollution control element in a pollution control device without breaking or cracking. When wrapped around a pollution control element, the ends of the multilayer mat can meet in a variety of junctions. For example, the ends can meet to form a linear junction that is perpendicular to the length of the multilayer mat. Multilayer mats that can form such a junction are shown in FIGS. 2A and 2B where the ends and edges of the multilayer mat meet to form a 90 degree angle (e.g., end 151 and edge 152 meet to form a 90 degree angle in FIG. 2A; end 156 and edge 157 from a 90 degree angle in FIG. 2B). When end 151 is joined with end 153 in multilayer mat 150 of FIG. 2A, a linear junction can be formed that is perpendicular to the length of the mat. Similarly, when ends 156 and 158 are joined in multilayer mat 155 of FIG. 2B, a linear junction can be formed that is perpendicular to the length of the mat.

Figure 5:
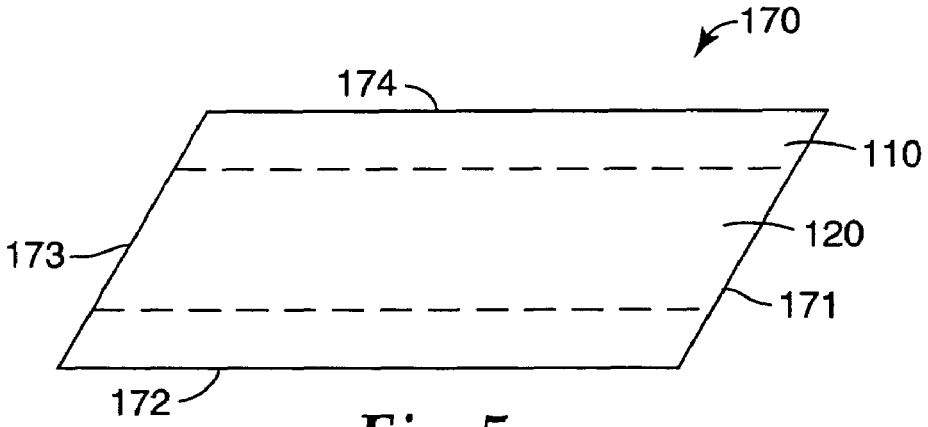
FIG. 5 is a schematic top view of an embodiment of a multilayer mat having a parallelogram shape with ends and edges that form an angle other than 90 degrees.

In other examples, the ends of the multilayer mat can meet to form a linear junction that is non-perpendicular to the length of the multilayer mat. A mat that will form a non-perpendicular junction with the length is shown in FIG. 5. The multilayer mat in FIG. 5 has a parallelogram shape having ends and edges that form an angle that is greater than or less than 90 degrees (e.g., end 171 and edges 172 form an angle greater than 90 degrees; end 173 and edge 172 form an angle less than 90 degrees). When end 173 is joined to end 171 in multilayer mat 170 of FIG. 5, a linear junction can be formed that is non-perpendicular to the length of the mat.

Figure 6:
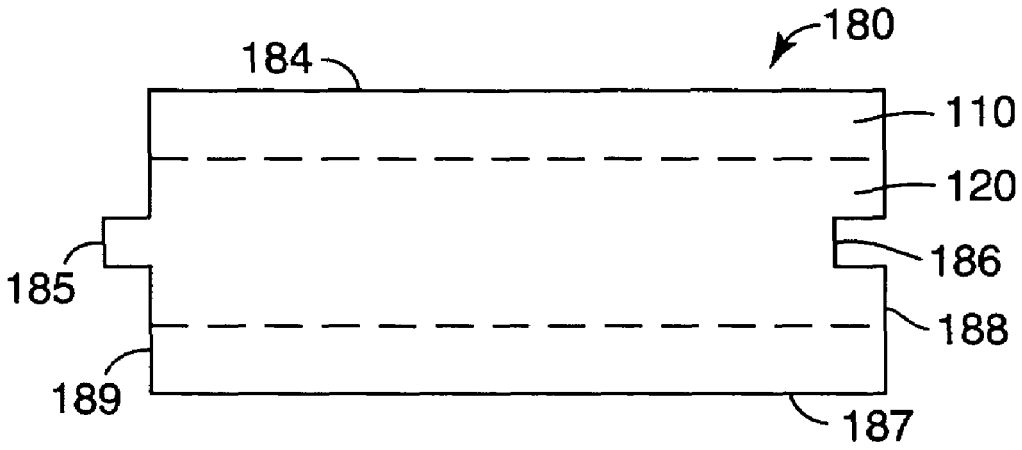
FIG. 6 is a schematic top view of a multilayer mat having opposite ends that can be joined with a tongue and groove construction.

Alternatively, the ends of the multilayer mat can be joined to form a non-linear junction. For example, the ends of the mat can be joined using a tongue 185 and groove 186 design as depicted in FIG. 6 for multilayer mat 180. That is, the tongue 185 can be placed in the groove 186 to join opposite ends (i.e., the first end is 188 and the second end is 189) of the multilayer mat 180. Any other suitable junction known in the art can be used.

The multilayer mats include a non-intumescent layer on both sides of an intumescent layer. The compositions of the first non-intumescent layer and the second non-intumescent layer can be the same or different. Each non-intumescent layer contains inorganic fibers. Any inorganic fiber that is known to be suitable for use in a mounting mat for a pollution control device can be selected. For example, the inorganic fibers can be alumina fibers, mullite fibers, quartz fibers, silicon carbide fibers, silicon nitride fibers, metal fibers, aluminosilicate fibers, magnesium aluminosilicate fibers, aluminoborosilicate fibers, zirconia fibers, titania fibers, and the like. The fibers can be amorphous, crystalline, or a combination thereof.

Quartz fibers are commercially available under the trade designation "ASTROQUARTZ" from J.P. Stevens, Inc. (Slater, N.C.). Silicon carbide fibers are commercially available from Nippon Carbon (Tokyo, Japan) under the trade designation "NICALON" or from Textron Specialty Materials (Lowell, Mass.) under the trade designation "TYRANNO". Silicon nitride fibers are commercially available from Toren Energy International Corp. (New York, N.Y.). Metal fibers are commercially available from Beckaert (Zweregan, Belgium) under the trade designation "BEKISHELD GR 90/C2/4" and from Ribbon Technology Corp. (Gahana, Ohio) under the trade designation "RIBTEC".

In some embodiments of the non-intumescent layer, the inorganic fibers are glass fibers. As used herein, the term "glass fibers" refers to inorganic fibers that are prepared from an inorganic fusion material that has been cooled without substantial crystallization. The glass fibers are amorphous as determined using either x-ray diffraction or transmission electron microscopic techniques. The glass fibers, at least in some applications, are shot free (i.e., the fibers contain no greater than 5 weight percent shot, no greater than 3 weight percent shot, no greater than 2 weight percent shot, no greater than 1 weight percent shot, or no greater than 0.5 weight percent shot). As used herein, the term "shot" refers to non-fibrous particles that can be a by-product of some inorganic fiber formation processes.

Suitable glass fibers are often magnesium aluminosilicate fibers. Such glass fibers can contain at least 50 weight percent $SiO_2$, at least 8 weight percent $Al_2O_3$, and at least 1 weight percent magnesium oxide. For example, magnesium aluminosilicate fibers can contain 50 to 70 weight percent, 50 to 60 weight percent, 60 to 70 weight percent, or 55 to 65 weight percent $SiO_2$; 8 to 30 weight percent, 10 to 20 weight percent, or 20 to 30 weight percent $Al_2O_3$; and 1 to 15 weight percent, 1 to 12 weight percent, 1 to 10 weight percent, or 1 to 8 weight percent magnesium oxide. Additional oxides can be present such as sodium oxide, potassium oxide, boron oxide, calcium oxide, and the like.

Specific examples of magnesium aluminosilicate glass fibers are E-glass fibers, S-glass fibers, S2-glass fibers, and R-glass fibers. E-glass fibers often contain about 55 weight percent $SiO_2$, about 11 weight percent $Al_2O_3$, about 6 weight percent $B_2O_3$, about 18 weight percent CaO, about 5 weight percent MgO, and about 5 weight percent other oxides. S-glass and S2-glass fibers typically contain about 65 weight percent $SiO_2$, about 25 weight percent $Al_2O_3$, and about 10 weight percent MgO. R-glass fibers usually contain about 60 weight percent $SiO_2$, about 25 weight percent $Al_2O_3$, about 9 weight percent CaO, and about 6 weight percent MgO. E-glass fibers, S-glass fibers, and S2-glass fibers are commercially available from Advanced Glassfiber Yarns, LLC (Aiken, S.C.) and Owens-Corning Fiberglass Corp. (Granville, Ohio). R-glass fibers are commercially available from Saint-Gobain Vetrotex (Herzogenrath, Germany).

Various refractory ceramic fibers can be used in the non-intumescent layer. In some embodiments, the ceramic fibers are amorphous and contain mainly $Al_2O_3$ and $SiO_2$. Small amounts of other oxides can be present. The weight ratio of $Al_2O_3$ to $SiO_2$ ($Al_2O_3$:$SiO_2$) is usually greater than or equal to 20:80, 30:70, 35:65, 40:60. 45:55, 50:50, 55:45, 60:40, or 70:30. The ceramic fibers typically include at least 30 weight percent $SiO_2$ and at least 20 weight percent $Al_2O_3$. For example, suitable ceramic fibers can contain $SiO_2$ in an amount of 30 to 80 weight percent and $Al_2O_3$ in an amount of 20 to 70 weight percent weight percent based on the weight of the fibers. In some specific examples, the ceramic fibers can contain $SiO_2$ in an amount of 40 to 60 weight percent and alumna in an amount of 40 to 60 weight percent based on the weight of the fibers. In other specific examples, the ceramic fibers can contain $SiO_2$ in an amount of 45 to 55 weight percent and $Al_2O_3$ in an amount of 45 to 55 weight percent based on the weight of the fibers.

Exemplary amorphous ceramic fibers that contain mainly $Al_2O_3$ and $SiO_2$ include, but are not limited to, those commercially available from Thermal Ceramics (Augusta, Ga.) under the trade designation "KAOWOOL HA BULK" with 50 weight percent $SiO_2$ and 50 weight percent $Al_2O_3$ based on the weight of the fibers; from Thermal Ceramics under the trade designation "CERAFIBER" with 54 weight percent $SiO_2$ and 46 weight percent $Al_2O_3$ based on the weight of the fiber; from Thermal Ceramics under the trade designation "KAOWOOL D73F" with 54 weight percent $SiO_2$ and 46 weight percent $Al_2O_3$ based on the weight of the fiber; from Rath (Wilmington, Del.) under the trade designation "RATH 2300 RT" with 52 weight percent $SiO_2$, 47 weight percent $Al_2O_3$, and no greater than 1 weight percent $Fe_2O_3$, $TiO_2$, and other oxides based on the weight of the fibers; from Rath under the trade designation "RATH ALUMINO-SILICATE CHOPPED FIBER" with 54 weight percent $SiO_2$, 46 weight percent $Al_2O_3$, and no greater than 1 weight percent of other oxides based on the weight of the fiber; from Vesuvius (Buffalo, N.Y.) under the trade designation "CER-WOOL RT" with 49 to 53 weight percent $SiO_2$, 43 to 47 weight percent $Al_2O_3$, 0.7 to 1.2 weight percent $Fe_2O_3$, 1.5 to 1.9 weight percent $TiO_2$, and no greater than 1 weight percent other oxides based on the weight of the fibers; from Vesuvius under the trade designation "CER-WOOL LT" with 49 to 57 weight percent $SiO_2$, 38 to 47 weight percent $Al_2O_3$, 0.7 to 1.5 weight percent $Fe_2O_3$, 1.6 to 1.9 weight percent $TiO_2$, and 0 to 0.5 weight percent other oxides based on the weight of the fibers; and from Vesuvius under the trade designation "CER-WOOL HP" with 50 to 54 weight percent $SiO_2$, 44 to 49 weight percent $Al_2O_3$, 0 to 0.2 weight percent $Fe_2O_3$, 0 to 0.1 weight percent $TiO_2$, and no greater than 0.5 weight percent other oxides based on the weight of the fibers.

In other embodiments, the ceramic fibers are amorphous and contain mainly $SiO_2$, $Al_2O_3$, and $ZrO_2$. Small amounts of other oxides can be present. The weight ratio of $Al_2O_3$ to $SiO_2$ ($Al_2O_3$:$SiO_2$) is greater than or equal to 20:80, 30:70, 35:65, 40:60. 45:55, 50:50, 55:45, 60:40, or 70:30. The fibers contain at least 3 weight percent $ZrO_2$, at least 30 weight percent $SiO_2$, and at least 20 weight percent $Al_2O_3$ based on the weight of the fiber. In some embodiments, the fibers contain $ZrO_2$ in an amount up to 5 weight percent, up to 7 weight percent, up to 10 weight percent, up to 12 weight percent, up to 15 weight percent, up to 16 weight percent, up to 20, or up to 25 weight percent based on the weight of the fibers. The ceramic fibers can contain $SiO_2$ in an amount of 30 to 70, 40 to 65, 45 to 60, 45 to 55, or 50 to 60 weight percent based on the weight of the fibers. The ceramic fibers can contain $Al_2O_3$ in an amount of 20 to 60, 25 to 50, 25 to 45, 25 to 40, 25 to 35, 30 to 50, or 30 to 40 weight percent based on the weight of the fibers. In some specific examples, the ceramic fibers contain 25 to 50 weight percent $Al_2O_3$, 40 to 60 weight percent $SiO_2$, and 3 to 20 weight percent $ZrO_2$ based on the weight of the fibers. In other specific examples, the ceramic fibers contain 30 to 40 weight percent $Al_2O_3$, 45 to 60 weight percent $SiO_2$, and 5 to 20 weight percent $ZrO_2$ based on the weight of the fibers.

Exemplary amorphous ceramic fibers that contain $SiO_2$, $Al_2O_3$, and $ZrO_2$ are commercially available from Thermal Ceramics (Augusta, Ga.) under the trade designation "KAOWOOL ZR" and "CERACHEM" with 50 weight percent $SiO_2$, 35 weight percent $Al_2O_3$, and 15 weight percent $ZrO_2$ based on the weight of the fiber; from Unifrax (Tonawonda, N.Y.) under the trade designation "UNIFRAX FIBERFRAX FIBERMAT" with 52 to 57 weight percent $SiO_2$, 29 to 47 weight percent $Al_2O_3$, and no greater than 18 weight percent $ZrO_2$ based on the weight of the fibers; from Unifrax under the trade designation "UNIFRAX FIBERFRAX DURABACK" with 50 to 54 weight percent $SiO_2$, 31 to 35 weight percent $Al_2O_3$, 5 weight percent $ZrO_2$, 1.3 weight percent $Fe_2O_3$, 1.7 weight percent $TiO_2$, 0.5 weight percent MgO, and no greater than 7 weight percent CaO based on the weight of the fibers; from Rath (Wilmington, Del.) under the trade designation "RATH 2600 HTZ" with 48 weight percent $SiO_2$, 37 weight percent $Al_2O_3$, 15 weight percent $ZrO_2$, and no greater than 1 weight percent other oxides based on the weight of the fibers; and from Vesuvius (Buffalo, N.Y.) under the trade designation "CER-WOOL HTZ" with 44 to 51 weight percent $SiO_2$, 33 to 37 weight percent $Al_2O_3$, 13 to 19 weight percent $ZrO_2$, 0.1 to 0.6 weight percent $Fe_2O_3$, 0.1 to 0.6 weight percent $TiO_2$, and no greater than 1 weight percent other oxides based on the weight of the fibers.

In some embodiments of the non-intumescent layer, the ceramic fibers have a bulk shrinkage no greater than 10 percent, no greater than 8 percent, no greater than 6 percent, no greater than 4 percent, no greater than 3 percent, no greater than 2 percent, or no greater than 1 percent using the Thermal Mechanical Analyzer (TMA) test. The ceramic fibers typically shrink at least 0.5 percent. In some embodiments, the ceramic fibers have a bulk shrinkage of 0.5 to 2 percent, 0.5 to 3 percent, 0.5 to 5 percent, or 0.5 to 6 percent.

In the TMA test, a sample under a load (e.g., 50 psi or 345 $N/m^2$) is heated to 1000° C. and then cooled. The caliper of the sample can be measured during both the heating and cooling cycles at 750° C. to calculate percent shrinkage. The percent shrinkage is equal to the difference in the caliper at 750° C. during the heating and cooling step multiplied by 100 and divided by the caliper at 750° C. during the heating step. The TMA test can be used to characterize the ceramic fibers or an non-intumescent layer prepared from ceramic fibers. Most or all of the organic materials that may be present in a non-intumescent layer are removed by time the temperature of the Thermal Mechanical Analyzer reaches 750° C.

Examples of ceramic fibers having a bulk shrinkage no greater than 10 percent as supplied (i.e., the fibers can be used as supplied without a heat-treatment) include, but are not limited to, fibers that are crystalline and that contain both $Al_2O_3$ and $SiO_2$. The weight ratio of $Al_2O_3$ to $SiO_2$ ($Al_2O_3$:$SiO_2$) can be greater than or equal to 60:40, 65:35, 70:30, 72:28, 75:25, 80:20, 90:10, 95:5, 96:4, 97:3, or 98:2. In some specific examples, the ceramic fibers contain 60 to 98 weight percent $Al_2O_3$ and 2 to 40 weight percent $SiO_2$ based on the weight of the fibers. In other specific examples, the ceramic fibers contain 70 to 98 weight percent $Al_2O_3$ and 2 to 30 weight percent $SiO_2$ based on the weight of the fibers. Traces of other oxides can be present. As used herein, the term "trace" refers to an amount no greater than 2 weight percent, no greater than 1 weight percent, or no greater than 0.5 weight percent.

Suitable ceramic fibers that are crystalline and have a bulk shrinkage no greater than 10 percent include, but are not limited, to those commercially available from Mitsubishi Chemical (Tokyo, Japan) under the trade designation "MAFTEC" (e.g., MLS1, MLS2, and MLS3) with 28 weight percent $SiO_2$ and 72 weight percent $Al_2O_3$ based on the weight of the fibers; from Saffil Limited (Widness Cheshire, U.K.) under the trade designation "SAFFIL" (e.g., SF, LA Bulk, HA Bulk, HX Bulk) with 3 to 5 weight percent $SiO_2$ and 95 to about 97 weight percent $Al_2O_3$ based on the weight of the fibers; and from Unifrax (Tonawonda, N.Y.) under the trade designation "UNIFRAX FIBERFRAX FIBERMAX" with 27 weight percent $SiO_2$ and 72 weight percent $Al_2O_3$ based on the weight of the fibers.

Further examples of ceramic fibers that are crystalline and have a bulk shrinkage no greater than 10 percent as supplied are aluminoborosilicate fibers. These fibers typically contain $Al_2O_3$ in an amount of at least 50 weight percent, $SiO_2$ in an amount no greater than 50 weight percent, and $B_2O_3$ in an amount no greater than 25 weight percent based on the weight of the fibers. Some specific aluminoborosilicate fibers contain 50 to 75 weight percent $Al_2O_3$, 25 to 50 weight percent $SiO_2$, and 1 to 25 weight percent $B_2O_3$ based on the weight of the fibers. Such aluminoborosilicate fibers are commercially available under the trade designation "NEXTEL 312" and "NEXTEL 440" from 3M Company (St. Paul, Minn.).

At least some of these ceramic fibers that are crystalline and that have a bulk shrinkage no greater than 10 percent as supplied by the manufacturer are prepared using a sol-gel process. In a sol-gel process, the ceramic fibers are formed by spinning or extruding a solution, dispersion, or viscous concentrate. The sol-gel process, which is further described in U.S. Pat. No. 3,760,049 (Borer et al.), can include extrusion of the solution, dispersion, or concentrate through orifices to form green fibers that are then fired to form ceramic fibers. The solution, dispersion, or concentrate contains the oxides or the precursors to the oxides that are in the fibers.

In some embodiments, commercially available amorphous ceramic fibers can be heat-treated to provide ceramic fibers that have a bulk shrinkage no greater than 10 percent. The ceramic fibers that can be heat-treated to provide fibers having a bulk shrinkage no greater than 10 percent typically are melt-blown or melt-spun from a mixture of $Al_2O_3$ and $SiO_2$ or a mixture of $Al_2O_3$ and $SiO_2$ with other oxides such as $B_2O_3$, $P_2O_5$, or $ZrO_2$. Exemplary amorphous ceramic fibers that can be heat-treated include, but are not limited to, ceramic fibers commercially available from Thermal Ceramics (Augusta, Ga.) under the trade designation "KAOWOOL HA BULK", "CERAFIBER", "KAOWOOL D73F", "KAOWOOL ZR", or "CERACHEM"; from Rath (Wilmington, Del.) under the trade designation "RATH 2300 RT", "RATH ALUMINOSILICIATE CHOPPED FIBER", or "RATH 2600 HTZ"; from Vesuvius (Buffalo, N.Y.) under the trade designation "CER-WOOL RT", "CER-WOOL LT", or "CER-WOOL HTZ", or "CER-WOOL HP"; and from Unifrax (Tonawonda, N.Y.) under the trade designation "UNIFRAX FIBERFRAX FIBERMAT" or "UNIFRAX FIBERFRAX DURABACK".

The ceramic fibers tend to devitrify (i.e., change, at least in part, from an amorphous state into a microcrystalline or crystalline state) during the heat-treatment process. Usually, only a portion of the individual ceramic fiber undergoes devitrification. That is, after heat-treatment, the individual ceramic fibers contain amorphous material as well as crystalline material, microcrystalline material, or a combination of crystalline and microcrystalline material.

Techniques such as transmission electron microscopy and x-ray diffraction can be used to characterize the amorphous, crystalline, or microcrystalline nature of inorganic fibers. As used herein, the term "amorphous" refers to inorganic fibers that are free of crystalline or microcrystalline regions. If the inorganic fibers are amorphous, no diffraction peaks (i.e., no diffraction pattern) can be detected using either transmission electron microscopy or x-ray diffraction. If the inorganic fiber contains regions having a small crystalline size (i.e., microcrystalline), diffraction peaks (i.e., a diffraction pattern) can be detected using transmission electron microscopy but not using x-ray diffraction. As used herein, the term "microcrystalline" refers to inorganic fibers that have at least some regions with a crystalline character and that have a crystal size detectable with transmission electron microscopy but not with x-ray diffraction. If the inorganic fibers contain regions having a larger crystalline size (i.e., crystalline), a diffraction pattern can be obtained using x-ray diffraction. As used herein, the term "crystalline" refers to inorganic fibers that have at least some regions with a crystalline character and that have a crystal size detectable with x-ray diffraction. The smallest crystal sizes detectable using x-ray diffraction typically results in a broad diffraction pattern without well-defined peaks. Narrower peaks indicate a larger crystalline size. The width of the diffraction peaks can be used to determine the crystalline size. The inorganic fibers that are crystalline are usually polycrystalline rather than being single crystals.

In some applications, the ceramic fibers are heat-treated at a temperature of at least 700° C. For example, the ceramic fibers can be heat-treated at a temperature of at least 800° C., at a temperature of at least 900° C., at a temperature of at least 1000° C., or at a temperature of at least 1100° C. Suitable heat-treatment temperatures can vary depending on the composition of the ceramic fibers and the time the ceramic fibers are held at the heat-treatment temperature. Suitable heat-treatment methods and suitable heat-treated ceramic fibers are further described, for example, in International Patent Application WO 99/46028 (Fernando et al.) and U.S. Pat. No. 5,250,269 (Langer), the disclosure of which are incorporated herein by reference.

There is a time-temperature relationship associated with the size of crystals or microcrystals that form during the heat-treatment process. For example, the ceramic fibers can be heat-treated at lower temperatures for longer periods of time or at higher temperatures for shorter periods of time to produce a comparable state of crystallinity or microcrystallinity. The time at the heat-treatment temperature can be up to 1 hour, up to 40 minutes, up to 30 minutes, up to 20 minutes, up to 10 minutes, up to 5 minute, up to 3 minutes, or up to 2 minutes. For example, the heat-treatment temperature can be chosen to use a relatively short heat-treatment time such as up to 10 minutes.

The temperature of the heat-treatment can be chosen to be at least 20° C., at least 30° C., at least 40° C., at least 50° C., at lest 60° C., at least 70° C., at least 80° C., at least 90° C., or at least 100° C. above the devitrification temperature (i.e., the temperature at which the ceramic fibers change from being an amorphous material to being a microcrystalline or crystalline material). Suitable heat-treatment times and temperatures for the ceramic fibers can be determined using techniques such as, for example, Differential Thermal Analysis (DTA). The temperature for $Al_2O_3$—$SiO_2$ fibers is typically in the range of 700° C. to 1200° C., in the range of 800° C. to 1200° C., in the range of 900° C. to 1200° C., or in the range of 950° C. to 1200° C.

A ceramic fiber that is completely amorphous usually shrinks more than ceramic fiber that contain regions that are microcrystalline, crystalline, or a combination thereof. Ceramic fibers that are at least partially crystalline or microcrystalline can be fabricated into mounting mats that can be repeatedly heated to a temperature suitable for use in a pollution control device and then cooled. Microcrystalline or crystalline ceramic fibers tend to be resistant to further shrinkage that could negatively impact the performance of the non-intumescent layer.

For ceramic fibers that are subjected to heat-treatment, the brittleness of the fibers can be balanced with the low bulk shrinkage characteristics. Crystalline or microcrystalline ceramic fibers tend to be more brittle than amorphous ceramic fibers. Non-intumescent layers made from crystalline or microcrystalline ceramic fibers can break more easily than insulation prepared from amorphous fibers. On the other hand, crystalline or microcrystalline ceramic fibers tend to have a lower bulk shrinkage than amorphous ceramic fibers.

The average diameter of the inorganic fibers is typically at least 3 micrometers, at least 4 micrometers, at least 5 micrometers, at least 6 micrometers, or at least 7 micrometers. The inorganic fibers usually have an average diameter that is no greater than 20 micrometers, no greater than 18 micrometers, no greater than 16 micrometers, or no greater than 14 micrometers. In some embodiments, at least 60 weight percent of the inorganic fibers have an average diameter that is within 3 micrometers of the average diameter. For example, at least 70 weight percent, at least 80 weight percent, or at least 90 weight percent of the inorganic fibers have an average diameter that is within 3 micrometers of the average diameter.

The non-intumescent layer can further contain an organic binder in amounts up to 20 weight percent based on the weight of the non-intumescent layer. In some embodiments, the organic binder is present in amounts up to 10 weight percent, up to 5 weight percent, or up to 3 weight percent based on the weight of the non-intumescent layer. The organic binder is typically burned off when the multilayer mat containing the non-intumescent layer is used at elevated temperatures such as those typically encountered in a pollution control device.

Suitable organic binder materials can include aqueous polymer emulsions, solvent-based polymers, and solvent free polymers. The aqueous polymer emulsions can include organic binder polymers and elastomers in the form of a latex (e.g., natural rubber lattices, styrene-butadiene lattices, butadiene-acrylonitrile lattices, and lattices of acrylate and methacrylate polymers or copolymers). The solvent-based polymeric binder materials can include a polymer such as an acrylic, a polyurethane, a vinyl acetate, a cellulose, or a rubber based organic polymer. The solvent free polymers can include natural rubber, styrene-butadiene rubber, and other elastomers.

In some embodiments, the organic binder material includes an aqueous acrylic emulsion. Acrylic emulsions advantageously tend to have good aging properties and non-corrosive combustion products. Suitable acrylic emulsions can include, but are not limited to, commercially available products such as those sold under the trade designation "RHOPLEX TR-934" (an aqueous acrylic emulsion having 44.5 weight percent solids) and "RHOPLEX HA-8" (an aqueous emulsion of acrylic copolymers having 45.5 weight percent solids) from Rohm and Hass (Philadelphia, Pa.); under the trade designation "NEOCRYL XA-2022" (an aqueous dispersion of an acrylic resins having 60.5 percent solids) available from ICI Resins US (Wilmington, Mass.); and under the trade designation "AIRFLEX 600BP DEV" (an aqueous emulsion of ethylene vinyl acrylate terpolymer having 55 weight percent solids) from Air Products and Chemical, Inc. (Philadelphia, Pa.).

Organic binders can also include a plasticizer, a tackifier, or a combination thereof. Plasticizers tend to soften a polymer matrix and can enhance the flexibility and moldability of the non-intumescent layer. For example, the organic binder can include a plasticizer such as isodecyl diphenyl diphosphate commercially available under the trade designation "SANTICIZER 148" from Monsanto (St. Louis, Mo.). Tackifiers or tackifying resins can aid in holding the insulation material together. An example of a suitable tackifier is commercially available from Eka Nobel, Inc. (Toronto, Canada) under the trade designation "SNOWTACK 810A".

The non-intumescent layer can also contain other materials such as, but not limited to, plasticizers, wetting agents, dispersants, defoaming agents, latex coagulants, and fungicides. Filler materials such as glass particles, calcium carbonate, expanded vermiculite, delaminated vermiculite, mica, perlite, aluminum trihydrate, magnesium phosphate hexahydrate, zinc borate, and magnesium hydroxide can be added. Additionally, inorganic binders such as clays, bentonite, and colloidal silica can be added.

The non-intumescent layers can also contain organic fibers such as, for example, acrylics, cellulose, polyolefin, polyvinyl alcohol, polyester, or combinations thereof. The fibers can be staple fibers or fibrillated fibers. Useful stable fibers typically have a size of about 0.5 to 5 denier. Suitable rayon fibers having a size of 1.5 denier per filament are commercially available from Minifiber, Inc. (Johnson City, Tex.). Suitable polyvinyl alcohol fibers are commercially available from Kuraray Americas, Inc. (New York, N.Y.) under the trade designation "KURALON". An acrylic fiber pulp is commercially available under the trade designation "CFF" from Cytek Industries, Inc. (West Paterson, N.J.).

A suitable non-intumescent layer can include, at least in some embodiment, inorganic fibers in an amount of 10 to 99.5 weight percent and organic binders in an amount of 0.5 to 20 weight percent. For example, the non-intumescent layer can contain inorganic fibers in an amount of 20 to 99.5 weight percent, organic binder in an amount of 0.5 to 20 weight percent, and up to 60 weight percent inorganic binders or fillers.

A suitable non-intumescent layer that contains heat-treated aluminosilicate ceramic fibers is commercially available from 3M Company (St. Paul, Minn.) under the trade designation "INTERAM 900HT". This mat has a bulk density of about 0.25 g/cm$^3$ and a weight per unit area of about 1020 to about 2455 g/m$^2$. Other suitable non-intumescent layers include those commercially available from 3M Company under the trade designation "INTERAM 1100HT" and "INTERAM 1101 HT". These mats have a bulk density of about 0.15 g/cm$^3$ and a weight per unit area of about 440 to about 2100 g/m$^2$. These mats contain crystalline alumina fibers (i.e., polycrystalline alumina fibers). Another suitable non-intumescent layer that includes magnesium aluminosilicate glass fibers is commercially available from 3M Company under the trade designation "INPE 571.02." This mat has a bulk density of 0.12 g/cm$^3$ and a weight per unit area of about 600 to about 1400 g/m$^2$. A needle-bonded mat is commercially available from Mitsubishi Chemical Company, Tokyo, Japan under the trade designation "MAFTEC MLS-3" with a bulk density of about 0.16 g/cm$^3$. This mat contains about 72 weight percent $Al_2O_3$ and about 28 weight percent $SiO_2$ based on the weight of the fibers.

In the multilayer mats, an intumescent layer is sandwiched between a first non-intumescent layer and a second non-intumescent layer. The intumescent layer contains at least one type of intumescent material. The intumescent layer can further include inorganic fibers, organic binders, plasticizers, wetting agents, dispersants, defoaming agents, latex coagulants, fungicides, filler materials, inorganic binders, and organic fibers. These additional components are the same as those discussed above for the non-intumescent layer.

Examples of suitable intumescent materials for the intumescent layer include unexpanded vermiculite, hydrobiotite, water swellable synthetic tetrasilicic fluorine type mica as described in U.S. Pat. No. 3,001,571 (Hatch), alkali metal silicate granules as described in U.S. Pat. No. 4,521,333 (Graham et al.), expandable graphite, or combinations thereof. Alkaline metal silicate granules are commercially available from 3M Company (St. Paul, Minn.) under the trade designation "EXPANTROL 4BW". Expandable graphite is commercially available under the trade designation "GRAFOIL GRADE 338-5O" from UCAR Carbon Co., Inc. (Cleveland, Ohio). Unexpanded vermiculite is commercially available from Cometals Inc. (New York, N.Y.). In some applications, the intumescent materials are selected from unexpanded vermiculite, expandable graphite, or a combination thereof.

The vermiculite can be treated, for example, with salts such as ammonium dihydrogen phosphate, ammonium nitrate, ammonium chloride, potassium chloride, or other soluble salts known in the art. The treatment is based on an ion exchange reaction.

The intumescent layer often contain at least 5, at least 10, at least 20, at least 40, or at least 60 weight percent intumescent material based on the weight of the intumescent layer. In some intumescent layers, the layer can be free of inorganic fibers. In other intumescent layers, the layer can be free of inorganic fibers and organic binders. In still other intumescent layers, the layer contains 5 to about 85 weight percent intumescent material and less than 20 weight percent organic binder based on the weight of the intumescent layer. Inorganic fibers are included in some intumescent layers.

In some more specific example, the intumescent layer includes intumescent materials in an amount of 5 to 85 weight percent, organic binder in an amount of 0.5 to 15 weight percent, and inorganic fibers in an amount of 10 to 60 weight percent based on the weight of the intumescent layer. In other examples, the intumescent layer includes intumescent materials in an amount of 5 to 70 weight percent, organic binder in an amount of 0.5 to 10 percent, and inorganic fibers in an amount of 30 to 45 weight percent based on the weight of the intumescent layer. In still other examples, the intumescent layer includes intumescent materials in an amount of 20 to 65 weight percent, organic binders in an amount of 0.5 to 20 weight percent, inorganic fibers in an amount of 10 to 65 weight percent, and up to 40 weight percent inorganic fillers or inorganic binders.

Suitable intumescent layers are commercially available from 3M (St. Paul, Minn.) under the trade designations "INTERAM 100", "INTERAM 200", "INTERAM 550", and "INTERAM 2000 LT". These mats usually have a bulk density of about 0.4 to about 0.7 g/cm$^3$ and a weight per unit area of about 1050 g/m$^2$ to about 8140 g/m$^2$. Another suitable intumescent layer is commercially available from 3M under the trade designation "INPE 570". This layer usually has a weight per unit area of about 1050 g/m$^2$ to about 4070 g/m$^2$ and contains inorganic fibers that that meet European non-classified fiber regulations.

In some intumescent layers, biosoluble inorganic fibers are included. Intumescent layers containing biosoluble fibers are further described in International Patent Application Publication WO 03/031368 (Howorth), incorporated herein by reference in its entirety. As used herein, "biosoluble inorganic fibers" refer to inorganic fibers that are decomposable in a physiological medium or a simulated physiological medium. Physiological medium refers to, but is not limited to, those bodily fluids typically found in the respiratory tract such as, for example, the lungs of animals or humans.

The biosoluble inorganic fibers typically include inorganic oxides such as, for example, $Na_2O$, $K_2O$, CaO, MgO, $P_2O_5$, $Li_2O$, and BaO, or combinations thereof with silica. Other metal oxides or other ceramic constituents can be included in the biosoluble inorganic fibers even though these constituents, by themselves, lack the desired solubility but are present in low enough quantities such that the fibers, as a whole, are still decomposable in a physiological medium. Such metal oxides include, for example, $Al_2O_3$, $TiO_2$, $ZrO_2$, $B_2O_3$, and iron oxides. The biosoluble inorganic fibers can also include metallic components in amounts such that the fibers are decomposable in a physiological medium or simulated physiological medium.

In one embodiment, the biosoluble inorganic fibers include silica, magnesium oxide, and calcium oxide. These types of fibers are typically referred to as calcium magnesium silicate fibers. The calcium magnesium silicate fibers usually contain less than about 10 weight percent aluminum oxide. Suitable biosoluble fibers can include 45 to 90 weight percent $SiO_2$, up to 45 weight percent CaO, up to 35 weight percent MgO, and less than 10 weight percent $Al_2O_3$. For example, the fibers can contain about 55 to about 75 weight percent $SiO_2$, about 25 to about 45 weight percent CaO, about 1 to about 10 weight percent MgO, and less than about 5 weight percent $Al_2O_3$.

Exemplary biosoluble inorganic oxides fibers are described in U.S. Pat. No. 5,332,699 (Olds et al.); U.S. Pat. No. 5,585,312 (TenEyck et al.); U.S. Pat. No. 5,714,421 (Olds et al.); and U.S. Pat. No. 5,874,375 (Zoitas et al.). Various methods can be used to form biosoluble inorganic fibers including, but not limited to, sol gel formation, crystal growing processes, and melt forming techniques such as spinning or blowing.

Biosoluble fibers are commercially available from Unifrax Corporation (Niagara Falls, N.Y.) under the trade designation "INSULFRAX". Other biosoluble fibers are sold by Thermal Ceramics (located in Augusta, Ga.) under the trade designation "SUPERWOOL." For example, SUPERWOOL 607 contains 60 to 70 weight percent $SiO_2$, 25 to 35 weight percent CaO, 4 to 7 weight percent MgO, and a trace amount of $Al_2O_3$. SUPERWOOL 607 MAX can be used at a slightly higher temperature and contains 60 to 70 weight percent $SiO_2$, 16 to 22 weight percent CaO, 12 to 19 weight percent MgO, and a trace amount of $Al_2O_3$.

Exemplary intumescent layer can include intumescent material in an amount of 10 to 80 weight percent, biosoluble inorganic fibers in an amount of 5 to 80 weight percent, micaceous binder in an amount of 5 to 80 weight percent, and organic binder in an amount of 0.5 to 20 weight percent.

As used herein, "micaceous binder" refers to one or more micaceous minerals that can be wetted and then dried to form a cohesive body that is self-supporting. As used herein, "self-supporting" refers to a micaceous binder that can be formed into a 5 cm×5 cm×3 mm sheet containing no other materials such that the dried sheet can be held horizontally at any edge for at least 5 minutes at 25° C. and up to 50 percent relative humidity without crumbling or otherwise falling apart.

As used herein, the phrase "micaceous mineral" refers to a family of minerals that can be split or otherwise separated into planar sheets or platelets. Micaceous minerals include, but are not limited to, expanded vermiculite, unexpanded vermiculite, and mica. Micaceous minerals typically have an average aspect ratio (i.e., the length of a particle divided by its thickness) that is greater than about 3. Micaceous minerals that typically have a particle size less than about 150 micrometers (e.g., the micaceous binder contains micaceous minerals that can pass through a 100 mesh screen). In some embodiments, the micaceous binder contains micaceous minerals having a size less than about 150 micrometers and having an average aspect ratio of greater than about 8 or greater than about 10.

Suitable micaceous binders can include micaceous minerals that have been crushed. As used herein, "crushed" refers to micaceous minerals that have been processed in any suitable manner that reduces the average particle size. Methods of crushing include, but are not limited to, mechanical shearing of a dilute or concentrated slurry, milling, air impact, and rolling. Other methods can be used alone or in combination with crushing to reduce the particle size. For example, thermal or chemical methods can be used to expand or expand plus exfoliate the micaceous minerals. Expanded vermiculite can be sheared or otherwise processed in water to produce an aqueous dispersion of delaminated vermiculite particles or platelets. Shearing can be adequately performed, for example, using a high shear mixer such as a blender.

In some embodiments, the micaceous binder includes processed vermiculites (i.e., vermiculate that has been expanded, delaminated, and crushed). Processed vermiculite is typically non-intumescent. In other embodiments, the micaceous binder includes vermiculite that has not been expanded and delaminated or that has been only partially expanded and delaminated. Such materials tend to be intumescent.

Suitable micaceous binders are commercially available from W. R. Grace & Company, and include a delaminated vermiculite powder (under the trade designation "VFPS") and an aqueous dispersion of chemically exfoliated vermiculite (under the trade designation "MICROLITE). Also, expanded vermiculite flakes are available from W.R. Grace and Company (under the trade designation "ZONELITE #5") that can be reduced in particle size to form a micaceous binder.

The micaceous binder can include vermiculite having a particle size less than about 150 micrometers and the intumescent material can include vermiculite having a particle size greater than about 150 micrometers (none passes through a 100 mesh screen). The intumescent vermiculite can have an average particle size that is greater than about 300 micrometers.

In one embodiment of a multilayer mat, the non-intumescent layer contains glass fibers and the intumescent layers contain vermiculite. In another embodiment of the multilayer mat, the non-intumescent layer contains refractory ceramic fibers having a shrinkage no greater than 10 percent based on the TMA test and the intumescent layers contain vermiculite.

Edge protection materials can be added to the multilayer mats. Edge protection materials can be stainless steel wire wrapped around the edges as described in U.S. Pat. No. 5,008,086 (Merry), incorporated herein by reference. Other suitable edge protection materials include braided or rope-like glass, ceramic, or metal fibers as described in U.S. Pat. No. 4,156,533 (Close et al.), incorporated herein by reference. Edge protection materials can also be formed from compositions having glass particles as described in EP 639 701 A2 (Howorth et al.), EP 639 702 A2 (Howorth et al.), and EP 639 700 A2 (Stroom et al.), all of which are incorporated by reference.

The thickness of each layer in the multilayer mat can vary depending on the particular application. In some embodiments, the thickness of the intumescent layer is no greater than the thickness of each of the non-intumescent layers. In some applications, the thickness of the intumescent is no greater than 50 percent, no greater than 45 percent, no greater than 40 percent, no greater than 35 percent, no greater than 30 percent, no greater than 25 percent, or no greater than 20 percent of the thickness of each of the non-intumescent layers.

The overall uncompressed thickness of the mat is typically no greater than 40 mm, no greater than 36 mm, no greater than 32 mm, no greater than 30 mm, no great than 24 mm, or no greater than 20 mm. The intumescent layer usually has a thickness that is not greater than 30 percent, no greater than 25 percent, no great than 20 percent, no greater than 15 percent, or no greater than 10 percent of the overall uncompressed thickness of the mat. In some examples, the thickness of the intumescent layer is 2 to 30 percent or 5 to 25 percent of the total uncompressed thickness of the multilayer mat.

In some applications, each non-intumescent layer independently has a thickness of at least 1, at least 2, at least 3 mm, at least 4 mm, at least 5 mm, or at least 6 mm. The thickness of each non-intumescent layer is typically less than 30 mm, less than 20 mm, or less than 15 mm. For example, the thickness of each of the non-intumescent layers independently can be 3 to 20 mm, 3 to 16 mm, 3 to 12 mm, 3 to 10 mm, 4 to 20 mm, 4 to 16 mm, 4 to 10 mm, 5 to 20 mm, 5 to 16 mm, 5 to 12 mm, 6 to 20 mm, 6 to 16 mm, 6 to 12 mm, or 6 to 10 mm. The thickness described herein refers to an uncompressed thickness.

The intumescent layer has a thickness of at least 0.5 mm, at least 0.8 mm, at least 1 mm, or at least 1.2 mm. The thickness of the intumescent layer is usually less than 20 mm, less than 10 mm, or less than 5 mm. For example, the thickness of the intumescent layer can be 0.5 to 10 mm, 0.5 to 8 mm, 0.5 to 6 mm, 0.5 to 5 mm, 0.5 to 3 mm, 0.5 to 2.5 mm, 0.5 to 2 mm, 0.8 to 3 mm, 1 to 3 mm, 1.2 to 3 mm, 1 to 2.5 mm, or 1 to 2 mm. The thickness described herein refers to an uncompressed thickness.

Each non-intumescent layer in the multilayer mat usually has a bulk density in the range of about 0.1 $g/cm^3$ to about 0.3 $g/cm^3$ while the intumescent layer has a bulk density in the range of about 0.4 $g/cm^3$ to about 0.7 $g/cm^3$. As used herein, the term "bulk density" refers to the density of a layer or multilayer mat that is not under compression. The bulk density of the multilayer mat depends on the thickness and composition of the various layers but is typically about 0.15 $g/cm^3$ to about 0.5 $g/cm^3$ or about 0.2 $g/cm^3$ to about 0.4 $cm^3$. In some applications, the multilayer mats have a compressed density of about 0.3 $g/cm^3$ to about 1.0 $g/cm^3$ or about 0.5 $g/cm^3$ to about 0.9 $g/cm^3$. As used herein, the term "compressed density" refers to the density of the multilayer mat after being assembled around a pollution control element in a pollution control device.

In another aspect, a method of forming a multilayer mat is described. An intumescent layer is provided that has a first major surface and a second major surface opposite the first major surface. The intumescent layer has an area A1. A first non-intumescent layer is positioned to face the first major surface of the intumescent layer. The first non-intumescent layer contains inorganic fibers and has an area A2 that is greater than area A1. A second non-intumescent layer is positioned to face the second major surface of the intumescent layer. The second non-intumescent layer contains inorganic fibers and has an area A3 that is greater than area A1. The intumescent layer is positioned entirely within the area of both the first non-intumescent layer and the second non-intumescent layer.

The area A2 of the first non-intumescent layer is substantially equal to the area A3 of the second non-intumescent layer. In some multilayer mats where area A2 is substantially equal to area A3, the first non-intumescent layer has a length L2 and the second non-intumescent layer has a length substantially equal to length L2 . Additionally, the first non-intumescent layer has a width W2 and the second non-intumescent layer has a width substantially equal to width W2.

In many embodiments of the multilayer mats, the first non-intumescent layer is aligned with the second non-intumescent layer. However, one of the layers can be somewhat skewed compared to the other layer as long as the multilayer mat can be effectively wrapped around a pollution control element within a pollution control device.

A paper making process is used to form the non-intumescent layer, the intumescent layers, or a combination thereof. For example, a non-intumescent layer can be prepared by forming an aqueous slurry containing the inorganic fibers. The aqueous slurry often contains up to 30 weight percent solids based on the weight of the slurry (e.g., the slurry can contain up to 20 weight percent or up to 10 weight percent solids based on the weight of the slurry). The slurry often contains at least 1 percent solids based on the weight of the slurry (e.g., slurry can contain at least 2 weight percent or at least 3 weight percent solids). In some embodiments, the slurry can contain 1 to 10, 2 to 8, or 3 to 6 weight percent solids. Higher solids can be advantageous because less water needs to be removed to prepare the preform. However, slurries with higher percent solids tend to be more difficult to mix.

The intumescent layer can be prepared by forming an aqueous slurry containing the intumescent material. The percent solids can be comparable to those used to prepare the non-intumescent layer. The aqueous slurry for the intumescent layer often contains inorganic fibers however intumescent layers can be free of inorganic fibers.

The water used in each aqueous slurry can be well water, surface water, or water that has been treated to remove impurities such as salts and organic compounds. When well or surface water is used in the aqueous slurry, salts (e.g., calcium and magnesium salts) present in the water can function as an inorganic binder. In some embodiments, the water is deionized water, distilled water, or a combination thereof.

Other additives can also be included in each aqueous slurry composition. Such additives can include inorganic binders, inorganic fillers, defoamers, flocculants, surfactants, and the like. Strength enhancing agents can also be included such as, for example, organic fibers.

Some of the non-intumescent layers have a non-flat surface on one side of the layer. A paper making process can be used to form such a non-intumescent layer. For example, a slurry can be deposited on a permeable substrate that has a non-flat surface. A trough in a non-intumescent layer could be formed by depositing a slurry on a permeable substrate that include a step or raised portion.

A non-intumescent layer that has a non-flat major surface can also be prepared using a molding technique. For example, a permeable forming die can be placed in the slurry. The solids in the slurry can deposit on the surface of the forming die when a vacuum is drawn. In some applications, the forming die can be removed from the slurry and coupled with a shape-retaining device having the same shape as the forming die. The deposited slurry can be positioned between the forming die and the shape-retaining device. The shape-retaining device and the forming die can be pressed together to further remove water and produce a preform having a relatively smooth surface. The shape-retaining device or the forming die can be the male molding part (i.e., if the forming die is the male molding part, then the shape-retaining device is the female molding part or if the forming die is the female molding part, then the shape-retaining device is the male molding part).

The permeable forming die can include, for example, a screen. The screen size can be chosen so that the liquid components but not the ceramic fibers pass through the screen. For example, the screens can be in the size range of 20 (about 850 microns) to 80 mesh (about 180 microns) or in the size range of 30 (about 600 microns) to 80 mesh. If the mesh size is too fine, the screen is easily plugged. If the mesh size is too large, the screen does not retain the ceramic fibers (i.e., a preform cannot be formed). Under normal operating conditions, some of the solids from the slurry deposit on the screen when a vacuum is pulled.

In some applications, the molding process can be similar to those disclosed in U.S. Pat. No. 5,078,822 (Hodges et al.) and U.S. Pat. No. 6,596,120 B2 (Davis et al.), the disclosure of which is incorporated herein by reference. The three-dimensional preform can be prepared using a die assembly that includes a multi-component die and a shape-retaining device. The multi-component die is a permeable forming die and usually includes an internal skeleton and an outer shell. The internal skeleton had a vacuum system through its interior to provide vacuum pull and vacuum distribution throughout the die. The outer shell of the forming die has a screen. For example, the screen can have a mesh size of 20 to 80 mesh. The multi-component forming die is permeable. The die assembly can be positioned in the slurry such that the multi-component forming die is separated from the shape-retaining device.

A vacuum can be connected to the multi-component forming die and a layer containing ceramic fibers can deposit on the forming die. While in a wet condition, the die-supported preform can be inserted into the shape-retaining device. The forming die can be removed where the preform is partially inserted into the shape-retaining device or when the preform is in full contact with the shape-retaining device. In some applications, the preform contacts the shape-retaining device while still being supported by the forming die.

One or both of the non-intumescent layers can have a non-flat surface. When one or both of the non-intumescent layers has a trough on one side of the layer, the intumescent layer can be positioned in the trough.

Other methods can be used to prepare the non-intumescent layer. In some applications, the non-intumescent layer can be prepared as a non-woven mat by chopping individual inorganic fibers to a desired length. Such a method is described in International Patent Application Publication WO 2004/011785 (Merry et al.), incorporated herein by reference. The individualized fibers can be prepared by chopping a tow or yarn of fiber using a glass roving cutter commercially available under the trade designation "MODEL 90 GLASS ROVING CUTTER" from Finn and Fram, Inc. (Pacoma, Calif.). Alternatively, the chopped individualized fibers can be formed using a hammer mill and then a blower. The fibers are usually chopped to a length ranging from about 0.5 to about 15 cm. A mat can be formed using a conventional web forming machine such as those commercially available from Rando Machine Corp. (Macedon, N.Y.) under the trade designation "RANDO WEBBER" or from ScanWeb Co. (Denmark) under the trade designation "DAN WEB". The chopped individualized fibers can be drawn onto a wire screen or mesh belt (e.g., a metal or nylon belt). Depending on the length of the fibers, the resulting mat can have sufficient handleability to be transferred to a needle punch or stitch bonding machine without a support such as a scrim. To facilitate ease of handing, some mats can be formed or placed on a scrim.

A needle-punched nonwoven mat refers to a mat where there is physical entanglement of the inorganic fibers provided by multiple full or partial penetrations of the mat with barbed needles. Needle punching generally involves compressing a nonwoven mat and then punching and drawing barbed needles through the mat. Although the optimum number of needle punches per area of mat depends on the particular application, the nonwoven mat is often punched to provide about 5 to about 60 punches/$cm^2$. In some applications the mats have 10 to about 20 punches/$cm^2$. The nonwoven mat can be needle punched using a conventional needle punching machine such as those commercially available from Dilo (Germany) with barbed needles commercially available from Foster Needle Company (Manitowoc, Wis.).

Alternatively, the nonwoven mat can be stitch bonded using techniques such as those disclosed in U.S. Pat. No. 4,181,514 (Lefkowitz et al.), the disclosure of which is incorporated herein by reference. The mat can be stitch bonded using an organic thread or an inorganic thread (e.g., ceramic or stainless steel). A relatively thin layer of inorganic or organic sheet material can be placed on either or both sides of the mat during stitching to prevent or minimize the threads from cutting through the mat. The spacing of the stitches can be varied but is usually about 3 to about 30 mm so that the fibers are uniformly compressed throughout the entire area of the mat. A commercially available needle punched non-intumescent layer can be obtained from Mitsubishi Chemical (Tokyo, Japan) under the trade designation "MAFTEC".

The intumescent layer can be in the form of a paste applied to a major surface of a non-intumescent layer. Suitable paste compositions for intumescent layers are further described, for example, in U.S. Pat. No. 5,853,675 (Howorth) and U.S. Pat. No. 5,207,989 (MacNeil), incorporated herein by reference. Some of these compositions include inorganic fibers in addition to the intumescent material. The pastes can be applied initially, for example, to a substrate such as a release liner or paper. The substrate can be removed after contacting the paste with a major surface of a non-intumescent layer.

In other multilayer mats, the intumescent layer can be formed by spraying a suitable intumescent composition onto a major surface of a non-intumescent layer. The compositions can include, for example, other materials such as inorganic fibers or organic binders. Alternatively, intumescent material free of a binder can be applied to a portion of a major surface of a non-intumescent layer. After the application of the intumescent material, another non-intumescent layer can be applied such that the intumescent material is sandwiched between the two non-intumescent layers.

In one method of making multilayer mats, a sheet of the first non-intumescent layer is provided. A sheet of the intumescent layer is positioned on one surface of the first non-intumescent layer. A sheet of the second non-intumescent layer is positioned over the intumescent sheet such that the intumescent sheet is sandwiched between the two non-intumescent sheets to form a multilayer construction. The multilayer construction can include a plurality of intumescent segments. The multilayer construction can be cut to have a size and shape suitable for use in a pollution control device. The multilayer construction can be cut to have a rectangular shape, a parallelogram shape, or a shape that includes a tongue and groove. For example, the multilayer construction can be cut to provide any of the multilayer mats depicted in FIGS. 2A, 2B, 3A, 3B, 4, or 6.

In another method of making multilayer mats, a first non-intumescent sheet having one or more troughs is provided. A sheet of intumescent layer is positioned in each trough. A second non-intumescent sheet that has a flat surface or a trough is positioned over the intumescent layer to form a multilayer construction. The multilayer construction can include a plurality of intumescent segments. The multilayer construction can be cut to have a size and shape suitable for use in a pollution control device. For example, the multilayer construction can be cut to have a rectangular shape, a parallelogram shape, or a shape that includes a tongue and groove.

The various layers can be individually prepared and then bonded together. The various layers of the multilayer mat can be bonded to each other using needle punching or stitch bonding techniques. Some of the multilayer mats have an adhesive to adhere the non-intumescent layer to the first intumescent layer, the second intumescent layer, or a combination thereof. Each layer can be prepared separately and then bonded together. The adhesive can be a pressure sensitive adhesive or a hot melt adhesive. In some multilayer mats, the adhesive is a hot melt adhesive such as, for example, the adhesive commercially available from Bostik-Findley (Stafford, UK) under the trade designation "PE 105-50" or "PE 65-50".

In some multilayer mats that are bonded together with an adhesive, the adhesive can be applied to the areas of at least one of the non-intumescent layers that is free of an adjacent intumescent layer. For example, in the multilayer mat shown schematically in FIG. 2A, the adhesive could be applied along edge 154 and 152.

The multilayer mat can be prepared using a paper making process. One such process is described in U.S. Patent Publication 2001/0046456 (Langer et al.), the disclosure of which is incorporated herein by reference. A first slurry containing inorganic fibers can be prepared and then deposited on a permeable substrate. The deposited first slurry can be partially dewatered to form a first layer. An intumescent composition can be applied to a portion of the first layer to form a second layer. The intumescent composition can be applied, for example, by spraying if the composition includes a liquid or by sprinkling if the composition is free of a liquid. A second slurry containing inorganic fibers can be prepared and then deposited on over the second layer and any exposed first layer. The deposited third slurry can be at least partially dewatered to form a third layer. After the final layer has been deposited, the mat can be dried to remove at least a portion of any remaining water. For example, the mat can be compressed and dried by passing the mat through heated rollers Such a process can result in some intermingling of the layers. The intermingling of the layers can be practically invisible to the eye or can be to such an extent that a visible boundary or gradient layer forms between two adjacent layers. With such a process, the layers can be bonded together without the use of an adhesive, stitches, needles, or staples.

Yet another aspect of the invention provides a pollution control device that includes an outer metal housing, a pollution control element, and a multilayer mat positioned between the pollution control element and the outer metal housing. The multilayer mat has at least three layers: an intumescent layer having a first major surface and a second major surface opposite the first major surface; a first non-intumescent layer facing the first major surface of the intumescent layer; and a second non-intumescent layer facing the second major surface of the intumescent layer. The intumescent layer has an area A1. The first non-intumescent layer contains inorganic fibers and has an area A2 that is greater than area A1. The second non-intumescent layer contains inorganic fibers and has an area A3 that is greater than A1. The intumescent layer is positioned entirely within the area of both the first non-intumescent layer and the second non-intumescent layer.

The area A2 of the first non-intumescent layer is substantially equal to the area A3 of the second non-intumescent layer. In some examples where area A2 is substantially equal to area A3, the first non-intumescent layer has a length L2 and the second non-intumescent layer has a length substantially equal to length L2 . Additionally, the first non-intumescent layer has a width W2 and the second non-intumescent layer has a width substantially equal to width W2.

In many embodiments of the multilayer mats, the first non-intumescent layer is aligned with the second non-intumescent layer. However, one of the layers can be somewhat skewed compared to the other layer as long as the multilayer mat can be effectively wrapped around a pollution control element.

Figure 7:
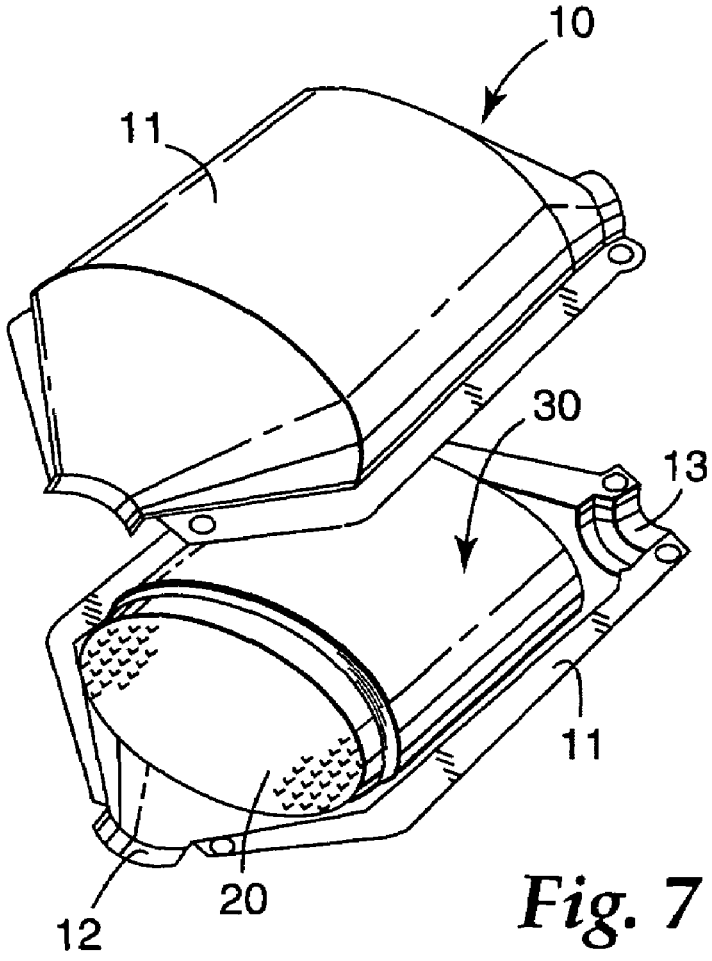
FIG. 7 is a schematic perspective view of a catalytic converter incorporating an embodiment of the present invention and shown in disassembled relation.

Pollution control devices are included in the exhaust system of motorized vehicles to reduce atmospheric pollution. An illustrative example of a pollution control device in the form of a catalytic converter 10 is shown in FIG. 7. The catalytic converter 10 generally includes a metal housing 11 surrounding a pollution control element 20, also referred to as a catalytic converter element or a monolith. The metal housing 11 has an inlet 12 and an outlet 13 through which a flow of exhaust gases flows into and out of catalytic converter 10, respectively. The metal housing 11, which is also referred to as a can or a casing, can be fabricated from one or more metals, metal alloys, or intermetallic compositions. For example, the metal housing 11 can be stainless steel or austenitic steel.

Suitable catalytic converter elements are known in the art and include those made of metal, ceramic, or other materials. A variety of ceramic catalytic converter elements are commercially available. For example, a honeycomb ceramic catalytic converter element is commercially available under the trade designation "CELCOR" by Corning Inc. (Corning, N.Y.), and another is commercially available under the trade designation "HONEYCERAM" by NGK Insulated Ltd (Nagoya, Japan). Metal catalytic converter elements are commercially available from Emitec (Lohmar, Germany).

One or more catalyst materials can be coated onto the catalytic converter element 20 in accordance with conventional practices. The catalysts used in the catalytic converter element 20 are typically one or more metals (e.g., ruthenium, osmium, rhodium, iridium, nickel, palladium, and platinum) and/or metal oxides (e.g., vanadium pentoxide and titanium dioxide). Most commonly, these catalysts function to oxidize or otherwise eliminate exhaust contaminants such as carbon monoxide and hydrocarbons. Such catalysts also can function to help reduce the amount of oxides of nitrogen in engine exhaust gases.

To provide a large amount of surface area, the catalytic converter element 20 generally has relatively thin walls. As a result of these thin walls, the catalytic converter element 20 can be fragile and susceptible to breakage. A mounting mat or sheet material 30, disposed between the metal housing 11 and the catalytic converter element 20, helps protect the fragile catalytic converter element 20 from damage due to road shock and vibration. Mounting mat or sheet material 30 also helps prevent exhaust gasses from passing between the catalytic converter element 20 and the metal housing 11.

Figure 8:
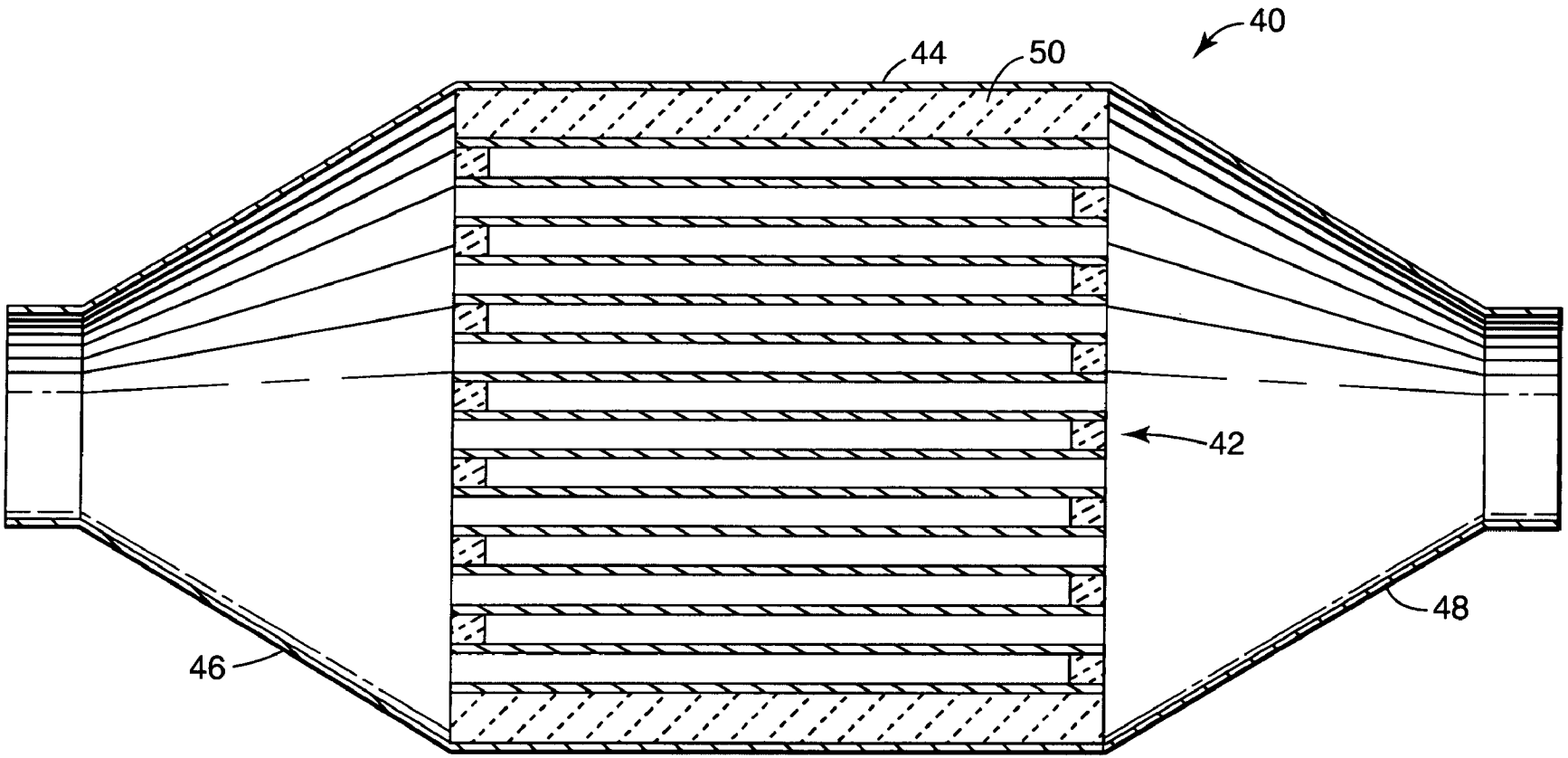
FIG. 8 is a schematic longitudinal central section through a diesel particulate filter incorporating an embodiment of the present invention.

FIG. 8 shows a representative example of a pollution control device in the form of diesel particulate filter 40. The diesel particulate filter 40 is a wall flow filter that includes a honeycombed monolithic structure 42 (also referred to as a monolith or monolithic structure) having a number of channels. A catalyst may be coated onto the monolithic structure 42 of the diesel particulate filter 40. The diesel particulate filter element is often prepared from a ceramic material. Such diesel particulate filter elements are commercially available from a number of sources including, for example, Corning Inc. (Corning, N.Y.) and NGK Intumescent Layer Ltd. (Nagoya, Japan). Useful diesel particulate filter elements are discussed in Howitt et al., "Cellular Ceramic Diesel Particulate Filter," Paper No. 810114, SAE Technical Paper Series, 1981.

The diesel particulate filter 40 includes a metal housing 44 having inlet 46 and outlet 48. Metal housing 44 surrounds the monolith 42. A mounting mat or sheet material 50, disposed between the monolith 42 and the metal housing 44, provides the same benefits as mounting mat 30 of FIG. 8.

Both the catalytic converter and diesel particulate filter elements are often in the form of a ceramic monolith. Ceramic monoliths are often described by their wall thickness as the number of openings or cells per square inch (cpsi). In the early 1970s, monoliths with a wall thickness of 12 mils and a cell density of 300 cpsi were common ("12/300 monoliths" where the numerator refers to the thickness of the wall in mils and the denominator refers to the number of cells per square inch). As emission laws have became more stringent, wall thicknesses have decreased as a way of increasing geometric surface area. The standard has progressed to 6/400 monoliths. However, to further enhance performance of the pollution control devices, even thinner walled monoliths such as 4/400, 4/600, 4/900, 3/600, 3/900, and 2/900 have been developed. These monoliths are even more delicate and more susceptible to breakage.

A ceramic monolith has a coefficient of thermal expansion that can be an order of magnitude less than the metal housing into which it is placed. In some pollution control devices, as the engine heats the pollution control element from about 25° C. to a maximum operating temperature of about 900° C., the metal housing increases to a temperature of about 530° C. (i.e., the temperature of the metal housing is lower because the outer surface of the metal housing is exposed to ambient conditions). Even though the metal housing undergoes a smaller temperature change than the pollution control element, the higher coefficient of thermal expansion of the metal housing compared to the ceramic monolith results in greater expansion of the metal housing. In some applications, the gap between the metal housing and the ceramic monolith can increase from about 4 mm to about 4.3 mm. The gap can be even greater than this in other applications.

The multilayer mats of the invention, depending on the composition, can be advantageously used under a variety of driving and temperatures conditions. The multilayer mats can be suitable for use with most known vehicular pollution control devices.

By sandwiching the intumescent layer between the non-intumescent layers, the intumescent material can be exposed to temperatures sufficient to expand but not to temperatures that would permanently alter the materials such that the expansion characteristic is altered. Vermiculite has a tendency to loose its expansions characteristics when exposed to temperatures in excess of about 700° C.

In many pollution control devices, the incoming gas stream can impinge the mounting mat and, at least with some mounting mats known in the art, can cause some erosion of the mounting mats. The intumescent material can become free of the mat over time as the mat is eroded. If the mounting mat contains intumescent material near the leading edge and the intumescent material becomes disconnected from the rest of the mat because of erosion, the intumescent material can become lodged in the monolith of the pollution control device. This lodged intumescent material can reduce the flow of gas through the monolith and increase system back pressure.

Thus, a multilayer mat that is free of intumescent material in the area subject to impingement from the incoming gas stream is less likely to have an incidence of monolith plugging over time. In some embodiments of the multilayer mat, the first non-intumescent layer can contact the second non-intumescent layer along at least one edge of the multilayer mat when the multilayer mat is under compression. This edge, which is free of intumescent material, can advantageously be positioned adjacent to the end of the pollution control element that is subjected to the incoming gas stream (i.e., leading edge).

In some pollution control devices, multiple pollution control elements are arranged in a series. For such pollution control devices, a multilayer mat advantageously can be constructed such that the first non-intumescent layer can contact the second non-intumescent layer along a first edge and along a second edge opposite the first edge. The multilayer mat can be wrapped around the first pollution control element such that the multilayer mat is free of intumescent material in the regions where gas enters (i.e., leading edge) or exits the pollution control element (i.e., trailing edge). The presence of an intumescent free edge positioned where the gas enters the first pollution control elements helps minimize plugging of the first pollution control element with intumescent material. The presence of an intumescent free edge positioned where the gas exits the first pollution control element helps minimize plugging of the second pollution control element.

In some multilayer mats, the intumescent layer is segmented. The segments can be positioned, for example, over the areas of the pollution control element with the smallest radius of curvature. These sections of the pollution control element tend to be the strongest and tend to be able to withstand the higher pressure that can result from the expansion of the intumescent material. Thus, at least in some pollution control devices, the use of a segmented intumescent layer can minimize cracking of the fragile monolithic structure in the pollution control element.

The intumescent layer in the multilayer mats of the invention has a smaller area than the non-intumescent layers (i.e., the area of the non-intumescent layers is greater than the area of the intumescent layer). When the intumescent material expands, the multilayer mat can exert pressure on the monolith. By reducing the area of the intumescent mat, the overall force exerted on the monolith can be reduced. This feature can, at least in some embodiments, reduce the likelihood that the monolith in the pollution control element will crack.

At least some of the multilayer mats have a mounting pressure that is less than a single layer mat of intumescent material. Thus, the multilayer mats under some conditions and in some applications are preferable to a single layer mat of intumescent material because the monolith is less likely to be fractured from an unacceptably high mounting pressure.

At least some of the multilayer mats have a mounting pressure that is greater than a single layer mat of non-intumescent material. Thus, the multilayer mats under some conditions and in some applications are preferable to a single layer mat of non-intumescent material because the monolith is held more effectively. That is, the gap between the monolith and the housing of the pollution control device is more effectively filled with some of the multilayer mats compared to a single layer non-intumescent mat.

The foregoing describes the invention in terms of embodiments foreseen by the inventor for which an enabling description was available, notwithstanding that insubstantial modifications of the invention, not presently foreseen, may nonetheless represent equivalents thereto.

EXAMPLES

Test Methods

Real Condition Fixture Test

The Real Condition Fixture Test (RCFT) simulates actual operating conditions found within a pollution control device having a monolith (e.g., a catalytic converter element or a diesel particulate filter) surrounded by a mounting mat. The test measures the pressure (i.e., mount pressure) exerted by the mounting mat. The RCFT method is described in detail in Hans Bode, ed., *Material Aspects in Automotive Pollution Control Devices*, Wiley-VCH, pp.-206-208 (2002).

A 44.45 mm by 44.45 mm sample of a multilayer mat was positioned between two 50.8 mm by 50.8 mm heated stainless steel platens. The mount density of the multilayer sample, i.e., when it was mounted between the platens, was 0.64 g/cm$^3$. One platen was heated to a temperature of 900° C. and the other was heated to 550° C. to simulate the temperatures found on the monolith side and the housing side of the mat, respectively, in a pollution control device during use. Simultaneously, the space or gap between the platens was increased by a value calculated from the temperature and the thermal expansion coefficients of the materials in a typical pollution control device of the type specified. Three cycles were run on each sample. For each cycle, each platens were heated to their peak temperatures of 900° C. or 550° C., held for 15 minutes, and then cooled to approximately room temperature, e.g. about 20° C.

After the three RCFT cycles were run, data curves were generated showing the pressure (i.e., mount pressure) between the two plates as a function of temperature. The mount pressure at the peak temperature during the first and third cycles as well as the mount pressure at room temperature was reported. A minimum mount pressure of about 50 kPa is generally needed to secure the monolith during actual use of the pollution control device.

Bulk Shrinkage (TMA)

The bulk shrinkage of a mass of ceramic fibers was determined by Thermal Mechanical Analysis (TMA) using a Theta Dilatronic II Thermal Analyzer, Model MFE-715 (obtained from Theta Industries, Inc., Port Washington, N.Y.) having a chart recorder. A sample of fiber was cut using a circular die having a diameter of 11 mm and placed on a platen in the furnace. A 7 mm diameter quartz rod (about 35.6 cm long) supporting a 1350 gram weight was placed over the sample and the furnace was closed. This corresponds to a load of about 50 psi (345 kN/m$^2$) applied to the sample. The sample with the applied weight was allowed to stabilize for about 5 minutes prior to heating to 1000° C. at a rate of 15° C./min. After the oven reached 1000° C., the furnace was turned off and cooled to room temperature. The sample was cooled within the furnace. The thickness of the sample, measured as the gap between the end of the rod and the platen, was plotted on a chart recorder during both the heating and cooling cycles. The percent shrinkage was calculated from the thickness (T1) recorded at 750° C. during the heating cycle and the thickness (T2) recorded at 750° C. during the cooling cycle. The bulk shrinkage was calculated as $$\% \text{ Bulk Shrinkage}=[(T1-T2)/T1]\times 100.$$

The TMA test can be used for samples with or without organic binder materials. Organic materials will usually burn out at about 500° C. During the heating cycle, the thickness of the sample measured at 750° C. is essentially the thickness of the mass of fibers with inorganic binders and particles, if present. As the sample is heated further, any shrinkage of the fibers that occurs up to 1000° C. will be apparent during the cooling cycle if the thickness measured at 750° C. is less than the thickness of the sample during the heating cycle.

Example 1

An intumescent layer was sandwiched between two non-intumescent layers to form a multilayer mat. The two non-intumescent layers were obtained from 3M Company (St. Paul, Minn.) under the trade designation "INTERAM 900 HT" Non-intumescent Insulation Mat. The non-intumescent layers each had a shape where the opposite ends of the mat could be joined with a tongue and groove (e.g., similar to the shape shown in FIG. 6). These non-intumescent layers were approximately 140 mm wide by 410 mm long. Each non-intumescent layer had a weight per unit area of 1020 g/m$^2$ and a thickness of about 4.1 mm. The intumescent mat was obtained from 3M Company under the trade designation "INTERAM 100" Intumescent Mat Mount. The intumescent mat had a weight per unit area of 1050 g/m$^2$ and a thickness of about 1.7 mm. Although the intumescent layer had approximately the same tongue and groove dimensions and length as the non-intumescent layers, the width was narrower (115 mm rather than 140 mm).

One major surface of each of the non-intumescent layers was sprayed with a foaming adhesive (available under the trade designation "FOAM FAST 74 SPRAY ADHESIVE" from 3M Company). The intumescent layer was laminated between the adhesive coated non-intumescent layers. The intumescent layer was approximately centered between the non-intumescent layers such that each lateral edge of the intumescent layer was set in about 12.5 mm from each lateral edge of the non-intumescent layers. That is, each lateral edge of the multilayer mat was free of intumescent material.

After pressing lightly on the laminate, the intumescent mat was completely enveloped within the non-intumescent layers. The multilayer mat was dried in an oven set at 85° C. for about 5 minutes and had a thickness of about 7.5 mm. The multilayer mat was tested using the RCFT at the maximum temperatures. The data for this sample is included in Table 1.

Reference Example R1

Reference Example R1 is an "INTERAM 100" Intumescent Mat Mount obtained from 3M Company (St. Paul, Minn.). Data for this sample is shown in Table 1.

Reference Example R2

Reference Example R2 is an "INTERAM 1100 HT" Non-intumescent Mat Mount available from 3M Company (St. Paul, Minn.). The mat contains crystalline (i.e., polycrystalline) alumina fibers. Data for this sample is shown in Table 1.

TABLE 1

| | Mounting Pressure | | |
|---|---|---|---|
| | Starting Pressure @ RT | Pressure 900° C./500° C. | |
| Example | 1$^{st}$ Cycle | 1$^{st}$ Cycle | 3$^{rd}$ Cycle |
| 1 | 224 kPa | 225 kPa | 124 kPa |
| R1 | 209 kPa | 1202 kPa | 570 kPa |
| R2 | 221 kPa | 56 kPa | 54k Pa |

Example 2

A multilayer mat is prepared according to the procedure of Example 1 except that the intumescent layer is cut so that one lateral edge of the intumescent layer is aligned with one lateral edge of the outer non-intumescent mats and the other lateral edge of the intumescent mat is set in about 13 mm from the lateral edge of the outer non-intumescent mats. The non-intumescent layers can be adhered to each other along the edge that is free of intumescent material.

Example 3

A multilayer mat is prepared according to the procedure of Example 1 except that no adhesive is used. Rather, the individual mats are needle punched together using barbed needles to provide a physical entanglement of fibers between the three layers. A suitable needle puncher is commercially available under the trade designation "DILO" from Dilo of Germany, with commercially available barbed needles (Foster Needle Company, Inc., (Manitowoc, Wis.)). The multilayer mat is needle punched to provide about 10 needle punches/cm$^2$. The intumescent layer is sandwiched between the two non-intumescent layers.

Example 4

A multilayer mat is prepared according to the method of Example 1 except that an acrylic adhesive tape is used in place of the foam adhesive. Further, the tape was applied only to the lateral edges of one of the non-intumescent layers. A 12 mm wide strip of a 0.13 mm thick acrylic adhesive transfer tape (available under the trade designation "ADHESIVE TRANSFER TAPE 468" from 3M Company (St. Paul Minn.)) was placed on a major surface of the lateral edges of one of the non-intumescent mats. The intumescent layer is positioned between the adhesive strips on the first non-intumescent layer. The second non-intumescent layer is positioned over the intumescent layer such that the intumescent layer is sandwiched between the two non-intumescent layers. The adhesive bonds the first non-intumescent layer to the second non-intumescent layer.

Example 5

A multilayer mat is prepared according to the method of Example 1 except that instead of the spray adhesive, sheets of hot melt web adhesive (available under the trade designation "PE 105-50 POLYESTER WEB ADHESIVE" from Bostik Findley Inc., (Middleton, Mass.)) are used to laminate the various layers of the multilayer mat. The adhesive is placed on the non-intumescent sheets and heated until molten (between about 110° C. and 140° C.) and then each is laminated to the intumescent mat with light pressure. The intumescent layer is sandwiched between the two non-intumescent layers.

Example 6

A multilayer mat is prepared according to the method of Example 5 except that 12 mm wide strips of the hot melt adhesive are positioned only along each lateral edge of one of the non-intumescent mats. After heating the non-intumescent layer to melt the adhesive, the intumescent mat is positioned on the first non-intumescent layer between the adhesive strips. The second non-intumescent mat is placed over the intumescent mat. The lateral edges are lightly pressed to hold the mats together. The intumescent layer is sandwiched between the two non-intumescent layers.

Example 7

Non-intumescent mats are prepared from heat-treated ceramic fibers according to the procedures described in PCT Patent Publication No. W00075496 (Langer). The ceramic fibers have composition of about 50% alumina and about 50% silica and are commercially available under the trade designation "KAOWOOL HA-BULK" from Thermal Ceramics (Augusta, Ga.). The fibers are heat-treated to have a bulk shrinkage of 4.5% as determined by the TMA test. A sufficient amount of heat-treating is obtained by heating the bulk fibers for about 3 minutes at 1060° C. The heat-treated fibers have an average diameter of about 3 microns and an average length less than about 10 mm. When analyzed using x-ray diffraction, a broad peak is obtained at a 2θ angle of about 22.5 degrees using a copper $K_\alpha$ line as the radiation source. The fibers contain crystalline regions but the crystalline size is not large enough to result in a narrow diffraction peak.

A multilayer mat is prepared according to the procedure of Example 6 using the non-intumescent heat-treated ceramic fiber mats. That is, the intumescent layer is "INTERAM 100" from 3M Company. Strips of the hot melt adhesive (12 mm wide) are positioned only along each lateral edge of one of the non-intumescent mats. After heating the non-intumescent layer to melt the adhesive, the intumescent mat is positioned on the first non-intumescent layer between the adhesive strips. The second non-intumescent mat is placed over the intumescent mat. The lateral edges are lightly pressed to hold the mats together. The intumescent layer is sandwiched between the two non-intumescent layers.

Example 8

A multilayer mat is prepared according to the procedure of Example 6 except that the non-intumescent mats are formed from crystalline (i.e., polycrystalline) alumina fibers. Such mats are commercially available under the trade designation "INTERAM 1100 HT" Non-intumescent Mat Mount from 3M Company (St. Paul Minn.).

Example 9

A multilayer mat is prepared according to the procedure of Example 1 except that the intumescent layer is cut into segments each measuring about 100 mm by 140 mm wide. Two segments of intumescent layer are positioned between the two non-intumescent layers such that when the mat is wrapped around a monolith having a elliptical shaped cross-section, the intumescent portions lie over the portions of the monolith with the smallest radius of curvature.

Example 10

A needle-bonded mat is prepared according to the procedure of Example 3 except that the two non-intumescent layers are not identical. One of the non-intumescent layers is a crystalline (i.e., polycrystalline) alumina fiber mat. Such a mat can be obtained under the trade designation "MAFTEC MLS-2" polycrystalline blanket, 800 g/m2 from Mitsubishi Chemical Co. (Tokyo, Japan). The other non-intumescent layer is formed according to the procedure described in Example 3 of PCT Publication WO 2004/011785 (Merry). The inorganic fiber is R-glass, available from Saint-Gobain Vetrotex with a typical composition of 60 weight percent $SiO_2$, 25 weight percent $Al_2O_3$, 9 weight percent CaO, and 6 weight percent MgO. The R-glass fibers have a diameter of about 10 micrometers and a length of about 36 mm. The R-glass non-intumescent layer is prepared using a machine commercially available from Rando Machine Corp. (Macedon, N.Y.) under the trade designation "RANDO WEBBER". This non-intumescent layer is needle bonded.

Example 11

A multilayer mat is prepared according to the procedure of Example 1 except that the intumescent layer is a mat prepared from ceramic fibers that meet European non-classified fiber regulations. Such a mat is available under the trade designation "INPE 570" Mat Mount from 3M Company (St. Paul, Minn.). The intumescent mat has a weight per area of 1050 $g/m^2$ and a thickness of about 1.7 mm.

Example 12

A multilayer mat is prepared by spraying a non-intumescent layer of "INTERAM 1100 HT" Mat Mount from 3M Company (St. Paul, Minn.) with a spray adhesive "FOAM FAST 74 SPRAY ADHESIVE" from 3M Company. Particles of unexpanded vermiculite available from Cometals Inc. (New York, N.Y.) are sprinkled on the center of the mat out to about 12 mm from the lateral edges of the mat. The particles are randomly distributed, leaving spaces between most of the particles. A second non-intumescent layer of "INTERAM 1100 HT" Mat Mount is pressed lightly on top of the particles.

Other embodiments of this invention will be apparent to those skilled in the art upon consideration of this specification or from practice of the invention disclosed herein. Various omissions, modifications, and changes to the principles and embodiments described herein may be made by one skilled in the art without departing from the true scope and spirit of the invention which is indicated by the following claims.

What is claimed is:

1. A multilayer mat comprising:

an intumescent layer having opposite outer edges, opposite ends, a first major surface and a second major surface opposite the first major surface, said intumescent layer having an area A1;

a first non-intumescent layer facing the first major surface of said intumescent layer, said first non-intumescent layer comprising inorganic fibers and said first non-intumescent layer having opposite outer edges, opposite ends, and an area A2 that is greater than area A1, wherein said first non-intumescent layer has a major surface facing said intumescent layer with a first trough in said major surface, and wherein said intumescent layer is positioned in said first trough; and a second non-intumescent layer facing the second major surface of said intumescent layer, said second non-intumescent layer comprising inorganic fibers and said second non-intumescent layer having opposite outer edges, opposite ends, and an area A3 that is greater than area A1, wherein said intumescent layer is sandwiched between said first and second non-intumescent layers and positioned entirely within the area A2 of said first non-intumescent layer and the area A3 of said second non-intumescent layer, with at least one of the outer edges of said mat being free of intumescent material.

2. The multilayer mat of claim 1, wherein area A2 is substantially equal to area A3 and said first non-intumescent layer is aligned with said second non-intumescent layer.

3. The multilayer mat of claim 1, wherein said first non-intumescent layer has a length L2 and said second non-intumescent layer has a length substantially equal to length L2 and wherein said first non-intumescent layer has a width W2 and said second non-intumescent layer has a width substantially equal to width W2.

4. The multilayer mat of claim 3, wherein said intumescent layer has a width W1 that is less than W2, said intumescent layer has a length L1 that is substantially equal to L2, and said second non-intumescent layer contacts said first non-intumescent layer along at least one edge of said multilayer mat.

5. The multilayer mat of claim 1, wherein said first non-intumescent layer contacts said second non-intumescent layer along at least one edge of the mat.

6. The multilayer mat of claim 1, wherein said intumescent layer is divided into at least two segments that are separated from each other.

7. The multilayer mat of claim 1, wherein said intumescent layer has a thickness that is 5 to 25 percent of a total mat thickness.

8. The multilayer mat of claim 1, wherein said second non-intumescent layer has a major surface facing said intumescent layer with a second trough in said major surface aligned with the first trough, and wherein said intumescent layer is positioned in the first and the second trough.

9. The multilayer mat of claim 1, wherein said multilayer mat is free of intumescent material along at least one lateral outer edge of said multilayer mat.

10. A pollution control device comprising:

an outer housing having an interior major surface;

a pollution control element; and a multilayer mounting mat positioned between said pollution control element and said outer housing, wherein the multilayer mounting mat has a major surface in contact with the internal major surface of the housing, and wherein the multilayer mat comprises:

an intumescent layer having opposite outer edges, opposite ends, a first major surface and a second major surface opposite the first major surface, said intumescent layer having an area A1;

a first non-intumescent layer facing the first major surface of said intumescent layer, said first non-intumescent layer comprising inorganic fibers and said first non-intumescent layer having opposite outer edges, opposite ends, and an area A2 that is greater than area A1; and a second non-intumescent layer facing the second major surface of said intumescent layer, said second non-intumescent layer comprising inorganic fibers and said second non-intumescent layer having opposite outer edges, opposite ends, and an area A3 that is greater than area A1, wherein said intumescent layer is sandwiched between said first and second non-intumescent layers and positioned entirely within the area A2 of said first non-intumescent layer and the area A3 of said second non-intumescent layer, with at least one of the outer edges of said mat being free of intumescent material, wherein one of the first or second non-intumescent layers has a major surface, and wherein the major surface of the multilayer mat in contact with the internal major surface of the housing is the major surface of one of the first or second non-intumescent layer.

11. The pollution control device of claim 10, wherein said multilayer mat is free of intumescent material along at least one lateral outer edge of said multilayer mat.

12. The pollution control device of claim 10, wherein area A2 is substantially equal to area A3 and said first non-intumescent layer is aligned with said second non-intumescent layer.

13. The pollution control device of claim 10, wherein said first non-intumescent layer has a length L2 and said second non-intumescent layer has a length substantially equal to length L2 and wherein said first non-intumescent layer has a width W2 and said second non-intumescent layer has a width substantially equal to width W2.

14. The pollution control device of claim 13, wherein said intumescent layer has a length W1 that is less than W2, said intumescent layer has a length L1 that is substantially equal to L2, and said second non-intumescent layer contacts said first non-intumescent layer along at least one edge of said multilayer mat.

15. The pollution control device of claim 10, wherein said first non-intumescent layer contacts said second non-intumescent layer along at least one edge of said mat, said at least one edge being positioned at a gas inlet side of said pollution control device.

16. The pollution control device of claim 10, wherein said intumescent layer is divided into at least two segments that are separated from each other.

17. The pollution control device of claim 16, wherein said pollution control element has an elliptical cross-section and the segments of said intumescent layer are positioned over portions of said pollution control element with a smaller radius of curvature.

18. A pollution control device comprising:

an outer housing having an interior major surface;

a pollution control element; and a multilayer mounting mat positioned between said pollution control element and said outer housing, wherein the multilayer mat comprises:

an intumescent layer having opposite outer edges, opposite ends, a first major surface and a second major surface opposite the first major surface, said intumescent layer having an area A1;

a first non-intumescent layer facing the first major surface of said intumescent layer, said first non-intumescent layer comprising inorganic fibers and said first non-intumescent layer having opposite outer edges, opposite ends, and an area A2 that is greater than area A1; and a second non-intumescent layer facing the second major surface of said intumescent layer, said second non-intumescent layer comprising inorganic fibers and said second non-intumescent layer having opposite outer edges, opposite ends, and an area A3 that is greater than area A1, wherein said intumescent layer is sandwiched between said first and second non-intumescent layers and positioned entirely within the area A2 of said first non-intumescent layer and the area A3 of said second non-intumescent layer, with at least one of the outer edges of said mat being free of intumescent material, and wherein one of the first or second non-intumescent layers has a major surface in contact with the internal major surface of the housing, wherein said first non-intumescent layer has a major surface facing said intumescent layer with a first trough in said major surface, wherein said intumescent layer is positioned in said first trough, and wherein said second non-intumescent layer has a major surface facing said intumescent layer with a second trough in said major surface aligned with the first trough, and wherein said intumescent layer is positioned in the first and the second trough.

19. A method of forming the multilayer mat of claim 1, said method comprising:

providing an intumescent layer having a first major surface and a second major surface opposite said first major surface, said intumescent layer having opposite outer edges, opposite ends and an area A1;

positioning a first non-intumescent layer facing the first major surface of said intumescent layer, said first non-intumescent layer comprising inorganic fibers and having opposite outer edges, opposite ends and an area A2 that is greater than area A1; and positioning a second non-intumescent layer facing the second major surface of said intumescent layer, said second non-intumescent layer being aligned with said first non-intumescent layer and comprising inorganic fibers, said second non-intumescent layer having opposite outer edges, opposite ends and an area A3 that is greater than area A1, wherein said intumescent layer is sandwiched between said first and second non-intumescent layers and positioned entirely within the area A2 of said first non-intumescent layer and the area A3 of said second non-intumescent layer, with at least one of the outer edges of said mat being free of intumescent material, and wherein said forming comprises molding to prepare a first non-intumescent layer having a major surface facing said intumescent layer with a first trough in said major surface, and wherein the method includes positioning said intumescent layer in said first trough.

20. The method of claim 19, wherein area A2 is substantially equal to area A3 and said first non-intumescent layer is aligned with said second non-intumescent layer.

21. The method of claim 19, wherein said first non-intumescent layer has a length L2 and said second non-intumescent layer has a length substantially equal to length L2 and wherein said first non-intumescent layer has a width W2 and said second non-intumescent layer has a width substantially equal to width W2.

22. The method of claim 21, wherein said intumescent layer has a width W1 that is less than W2, said intumescent layer has a length L1 is substantially equal to L2, and said multilayer mat is free of intumescent material along at least one edge of said multilayer mat.

23. The method of claim 19, wherein said intumescent layer has a thickness that is 5 to 25 percent of a total mat thickness.

24. The method of claim 19, wherein said positioning comprises preparing an intumescent layer having at least two segments and separating the segments.

25. The method of claim 19, said method further comprising cutting said multilayer mat to a size suitable for use as a mounting mat in a pollution control device.

* * * * *

UNITED STATES PATENT AND TRADEMARK OFFICE

CERTIFICATE OF CORRECTION

PATENT NO. : 7,645,426 B2
APPLICATION NO. : 10/824029
DATED : January 12, 2010
INVENTOR(S) : Richard P. Merry It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1133 days.

Signed and Sealed this

Sixteenth Day of November, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,645,426 B2
APPLICATION NO. : 10/824029
DATED : January 12, 2010
INVENTOR(S) : Richard Paul Merry It is certified that error appears in the above-identified patent and that said Letters Patent is hereby corrected as shown below:

Column 3 – Line 45 (Approx.) - Delete "L2 ." and insert -- L2. --.

Column 5 – Line 41 - Delete "L1 a" and insert -- L1a --.

Column 5 – Line 42 - Delete "L1 b" and insert -- L1b --.

Column 5 – Line 43 - Delete "L2 ," and insert -- L2, --.

Column 19 – Line 1 - Delete "L2 ." and insert -- L2. --.

Column 23 – Line 3 - Delete "L2 ." and insert -- L2. --.

Column 27 – Line 65 - Delete "54k Pa" and insert -- 54 kPa --.

Column 29 – Line 8 - Delete "W00075496" and insert -- WO 00/75496 --.

Signed and Sealed this
Twelfth Day of July, 2011

David J. Kappos

David J. Kappos
*Director of the United States Patent and Trademark Office*